US006790569B2

(12) United States Patent
Yang et al.

(10) Patent No.: US 6,790,569 B2
(45) Date of Patent: Sep. 14, 2004

(54) COLOR PHOTOTHERMOGRAPHIC ELEMENTS COMPRISING PHENOLIC THERMAL SOLVENTS

(75) Inventors: Xiqiang Yang, Webster, NY (US); Zbyslaw R. Owczarczyk, Webster, NY (US); David T. Southby, Rochester, NY (US); Mark E. Irving, Rochester, NY (US); Paul B. Merkel, Victor, NY (US); Lyn M. Irving, Rochester, NY (US); David H. Levy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/858,398

(22) Filed: May 16, 2001

(65) Prior Publication Data

US 2002/0025498 A1 Feb. 28, 2002

Related U.S. Application Data

(60) Provisional application No. 60/211,452, filed on Jun. 13, 2000.

(51) Int. Cl.[7] ..... G03C 5/16

(52) U.S. Cl. ..... 430/21; 430/203; 430/351; 430/363; 430/364; 430/380; 430/543; 430/505; 430/566; 430/619; 430/964

(58) Field of Search ..... 430/21, 351, 380, 430/364, 543, 363, 566, 620, 505, 203, 619, 964

(56) References Cited

U.S. PATENT DOCUMENTS 3,667,959 A 6/1972 Bojara et al.
4,584,267 A 4/1986 Masukawa et al.
4,770,981 A 9/1988 Komamura et al.
4,789,623 A * 12/1988 Sato ..... 430/351

(List continued on next page.)

FOREIGN PATENT DOCUMENTS

EP 0 573 048 A2 12/1993
EP 0800114 A2 * 10/1997
EP 1 113 316 A2 7/2001
EP 1 113 324 A2 7/2001

OTHER PUBLICATIONS

C. Hansch and A.J. Leo, in "Substituent Constants for Correction Analysis in Chemistry and Bilogy", Weiley, New York, 1979.*

(List continued on next page.)

*Primary Examiner*—Thorl Chea
(74) *Attorney, Agent, or Firm*—Chris P. KonKol

(57) ABSTRACT

A color photothermographic element comprising at least three light-sensitive units which have their individual sensitivities in different wavelength regions, each of the units comprising at least one light-sensitive silver-halide emulsion, binder, and dye-providing coupler, and a blocked developer in the presence of a thermal solvent represented by the following structure:

I wherein the groups are as defined in the specification to promote the thermal development of the photothermographic element.

31 Claims, 2 Drawing Sheets

U.S. PATENT DOCUMENTS

| | | | |
|---|---|---|---|
| 4,948,698 | A | 8/1990 | Komamura |
| 4,952,479 | A | 8/1990 | Aono et al. |
| 4,983,502 | A | 1/1991 | Ohbayashi et al. |
| 5,352,561 | A | 10/1994 | Bailey et al. |
| 5,436,109 | A | 7/1995 | Bailey et al. |
| 5,468,587 | A | 11/1995 | Bailey et al. |

OTHER PUBLICATIONS

Defensive Publication 825,478, Published Oct. 21, 1969, 867 O.G. 748, Dry Processed Photographic Materials Containing Preprocessing Stabilizers, Ralph W. Baxendale and George F. L. Wood, Eastman Kodak Co., filed Mar. 28, 1969.

Database WPI Section Ch, Week 198730, Derwent Publications Ltd., London, GB; AN 1987–209836, XP–002186383 & JP 62 136645 A (Konishiroku Photo Ind Co Ltd), Jun. 19, 1987 abstract, *compounds 5, 8, 9, 22, 23 *.

* cited by examiner

COLOR PHOTOTHERMOGRAPHIC ELEMENTS COMPRISING PHENOLIC THERMAL SOLVENTS

CROSS REFERENCE TO RELATED APPLICATION

Reference is made to and priority claimed from U.S. Provisional Application Ser. No. 60/211,452, filed Jun. 13, 2000, entitled COLOR PHOTO THERMOGRAPHIC ELEMENTS COMPRISING PHENOLIC THERMAL SOLVENTS.

FIELD OF THE INVENTION

This invention relates to color photothermographic imaging systems that utilize silver halide based radiation sensitive layers and associated formation of image dyes. In particular, this invention relates to such systems where at least one image dye is the reaction product of an image coupler and a thermally activated blocked developer in the presence of a phenolic compound.

BACKGROUND OF THE INVENTION

Thermal solvents for use in photothermographic and thermographic systems are generally known. Heat processable photosensitive elements can be constructed so that after exposure, they can be processed in a substantially dry state by applying heat. Because of the much greater challenges involved in developing a dry or substantially dry color photothermographic system, however, most of the activity to date has been limited to black and white photothermographic systems, especially in the areas of health imaging and microfiche.

It is known how to develop latent image in a photographic element not containing silver halide wherein organic silver salts are used as a source of silver for image formation and amplification. Such processes are described in U.S. Pat. No. 3,429,706 (Shepard et al.) and U.S. Pat. No. 3,442,682 (Fukawa et al.). Dry processing thermographic systems are described in U.S. Pat. No. 3,152,904 (Sorenson et al.) and U.S. Pat. No. 3,457,075 (Morgan and Shely). A variety of compounds have been proposed as "carriers" or "thermal solvents" or "heat solvents" for such systems, whereby these additives serve as solvents for incorporated developing agents, or otherwise facilitate the resulting development or silver diffusion processes. Acid amides and carbamates have been proposed as such thermal solvents by Henn and Miller (U.S. Pat. No. 3,347,675) and by Yudelson (U.S. Pat. No. 3,438,776). Bojara and de Mauriac (U.S. Pat. No. 3,667,959) disclose the use of non-aqueous polar solvents containing thione, —$SO_2$— and —CO— groups as thermal solvents and carriers in such photographic elements. Similarly, La Rossa (U.S. Pat. No. 4,168,980) discloses the use of imidazoline-2-thiones as processing addenda in heat developable photographic materials. Takahashi (U.S. Pat. No. 4,927,731) discloses a microencapsulated base activated heat developable photographic polymerization element containing silver halide, a reducing agent, a polymerizable compound, contained in a microcapsule and separate from a base or base precursor. In addition, a sulfonamide compound is included as a development accelerator.

Thermal solvents for use in substantially dry color photothermographic systems have been disclosed by Komamura et al. (U.S. Pat. No. 4,770,981), Komamura (U.S. Pat. No. 4,948,698), Aomo and Nakamaura (U.S. Pat. No. 4,952,479), and Ohbayashi et al. (U.S. Pat. No. 4,983,502). The terms "heat solvent" and "thermal solvent" in these disclosures refer to a substantially non-hydrolyzable organic material which is a liquid at ambient temperature or a solid at an ambient temperature but mixes (dissolves or melts or both) with other components at a temperature of heat treatment or below but higher than 40° C., preferably above 50° C. Such solvents may also be solids at temperatures above the thermal processing temperature. Their preferred examples include compounds which can act as a solvent for the developing agent and compounds having a high dielectric constant which accelerate physical development of silver salts. Alkyl and aryl amides are disclosed as "heat solvents" by Komamura et al. (U.S. Pat. No. 4,770,981), and a variety of benzamides have been disclosed as "heat solvents" by Ohbayashi et al. (U.S. Pat. No. 4,983,502). Polyglycols, derivatives of polyethylene oxides, beeswax, monostearin, high dielectric constant compounds having an —$SO_2$— or —CO— group such as acetamide, ethylcarbamate, urea, methylsulfonamide, polar substances described in U.S. Pat. No. 3,667,959, lactone of 4-hydroxybutanoic acid, methyl anisate, and related compounds are disclosed as thermal solvents in such systems. The role of thermal solvents in these systems is not clear, but it is believed that such thermal solvents promote the diffusion of reactants at the time of thermal development. Masukawa and Koshizuka disclose (in U.S. Pat. No. 4,584,267) the use of similar components (such as methyl anisate) as "heat fusers" in thermally developable light-sensitive materials. Baxendale and Wood in the Defensive Publication corresponding to U.S. application Ser. No. 825,478 filed Mar. 17, 1969 disclose water soluble lower-alkyl hydroxybenzoates as preprocessing stabilizers in silver salt heat-developable photographic elements.

U.S. Pat. No. 5,352,561 to Bailey et al. discloses the use of phenolic compounds (hydroxybenzene derivatives) for forming an improved dye image in an aqueous developable photographic dry dye-diffusion transfer element. A color coupler forms or releases a heat-transferable dye upon reaction of the coupler with the oxidation product of a primary amine developing agent. A dye receiving layer is placed in physical contact with the dye-diffusion transfer element and then combination heated to effect dye-diffusion.

Phenolic compounds are also disclosed for use in non-photothermographic systems. Okonogi et al. (U.S. Pat. No. 4,228,235) disclose 2,6-dialkyl hydroxybenzoates as dye light-fade stabilizers in an integral photographic, or non-diffusion transfer type, element. Hirano et al. (U.S. Pat. No. 4,474,874) disclose 5-substituted pyrogallols with amide, acyl, sulfone, or sulfate groups as color fog preventative agents (interlayer scavengers) in an integral photographic element or in an aqueous alkali color image transfer element Takahashi et al. (U.S. Pat. No. 5,169,742) disclose phenols with sulfone, amide and ester substituents as interlayer scavengers in an integral photographic element. Waki et al. (U.S. Pat. No. 4,626,494) describes an aqueous alkali activated image transfer element containing coupler solvents including 2-ethylhexyl hydroxybenzoate. Takahashi et al. (European Patent Application No. 276,319) disclose image generating layers incorporating low levels of hydroxybenzoates, salicylates and o-hydroxybenzophenones as dye light-stabilizers. Thirtle and Weissberger (U.S. Pat. No. 2,835,579) disclose aqueous processable color photographic elements that contain 2,4-di-n-alkyl-, 2-n-alkyl4-n-alkylacyl or 2-n-alkylacyl-4-n-alkylphenols as solvents for dye forming couplers. Sakai et al. (U.S. Pat. No. 4,774,166) disclose seven classes of materials, including as members of one class, arylsulfonylphenols, arylsulfamoylphenols and arylacylphenols as coupling-activity enhancing compounds employed in development processes not containing benzyl alcohol. Ishikawa and Sato (Japanese Kokai No. 62-25754) disclose hydroxybenzoates and salicylates as coupling-activity enhancing compounds in color photographic elements. Kimura et al. (U.S. Pat. No. 4,551,422) disclose the incorporation of substituted phenols, including alkylphenols, hydroxybenzoates and acylphenols in color photographic elements as hue shifting addenda.

It is an object of the present invention to provide an improved thermal solvent for photothermographic color elements. There is a need for a thermal solvent, in a photothermographic imaging element, that allows a blocked developing agent to be stable until development yet promotes rapid color development once processing has been initiated by heating the element and/or by applying a small amount of processing solution in a substantially dry environment, such as a solution of a base or acid or pure water held in a laminate for contact with the photothermographic element. A color photothermographic element that could be thermally developed by a dry or substantially dry process would be highly desirable. The existence of such developer chemistry would allow for very rapidly processed films that can be processed simply and efficiently in low cost photoprocessing kiosks.

PROBLEMS TO BE SOLVED BY THE INVENTION

A major problem that remains in dry phototothermographic systems, wherein the dye images require the reaction of a blocked developer and a dye-forming coupler through substantially dry gelatin, is how to facilitate the speed and ease with which such dye images may be formed. These and other problems may be overcome by the practice of our invention.

SUMMARY OF THE INVENTION

An object of the present invention is to overcome the disadvantages of the prior processes and products relating to color photothermographic systems. A further object of the present invention is to provide improved image dye formation in color photothermographic elements. In particular, the invention provides a chromogenic photothermographic element comprising radiation sensitive silver halide, a blocked developing agent, at least one coupler that forms an image dye upon reaction of said compound with the oxidation product of the unblocked developing agent, a hydrophilic binder, and a thermal solvent for facilitating dye image formation wherein said thermal solvent is a phenol or derivatives thereof that are essentially or substantially non-hydrolyzable and, when in the photographic element, soluble in the hydrophilic binder at ambient temperature or a solid at an ambient temperature but mixes (dissolves or melts or both) with other components, especially the blocked developer and coupler, at the temperature of heat treatment or below, but higher than 40° C. and preferably above 50° C.

The color photothermographic element comprises a blocked developer that decomposes (i.e., unblocks) on thermal activation to release a developing agent, wherein thermal activation is at a temperature of at least 60° C., preferably at least 80° C., more preferably at least 100° C. In dry processing embodiments, thermal activation preferably occurs at temperatures between about 80 to 180° C., preferably 100 to 160° C. In not completely dry development ("substantially dry") systems, thermal activation preferably occurs at temperatures between about 60 and 140° C. in the presence of added acid, base and/or water. In one preferred embodiment of the invention, the photothermographic element comprises an effective amount of a thermal solvent. In another preferred embodiment of the invention, the photothermographic element comprises a mixture of organic silver salts (inclusive of complexes) at least one of which is a silver donor, in order to reduce the amount of fog during thermal development.

The invention additionally relates to a method of image formation having the steps of: thermally developing an imagewise exposed photographic element having a blocked developer in association with a phenolic thermal solvent that decomposes on thermal activation to release a developing agent that reacts with a coupler to form a developed image. In one embodiment of the invention, a positive image can be formed by scanning the developed image to form a first electronic image representation (or "electronic record") from said developed image, digitizing said first electronic record to form a digital image, modifying said digital image to form a second electronic image representation, and storing, transmitting, printing or displaying said second electronic image representation.

The invention further relates to a one-time use camera having a light sensitive photographic element comprising a support and a blocked developer that decomposes to release a photographically useful group on thermal activation. The invention further relates to a method of image formation having the steps of imagewise exposing such a light sensitive photographic element in a one-time-use camera having a heater and thermally processing the exposed element in the camera.

DETAILED DESCRIPTION OF THE INVENTION

Figure 1:
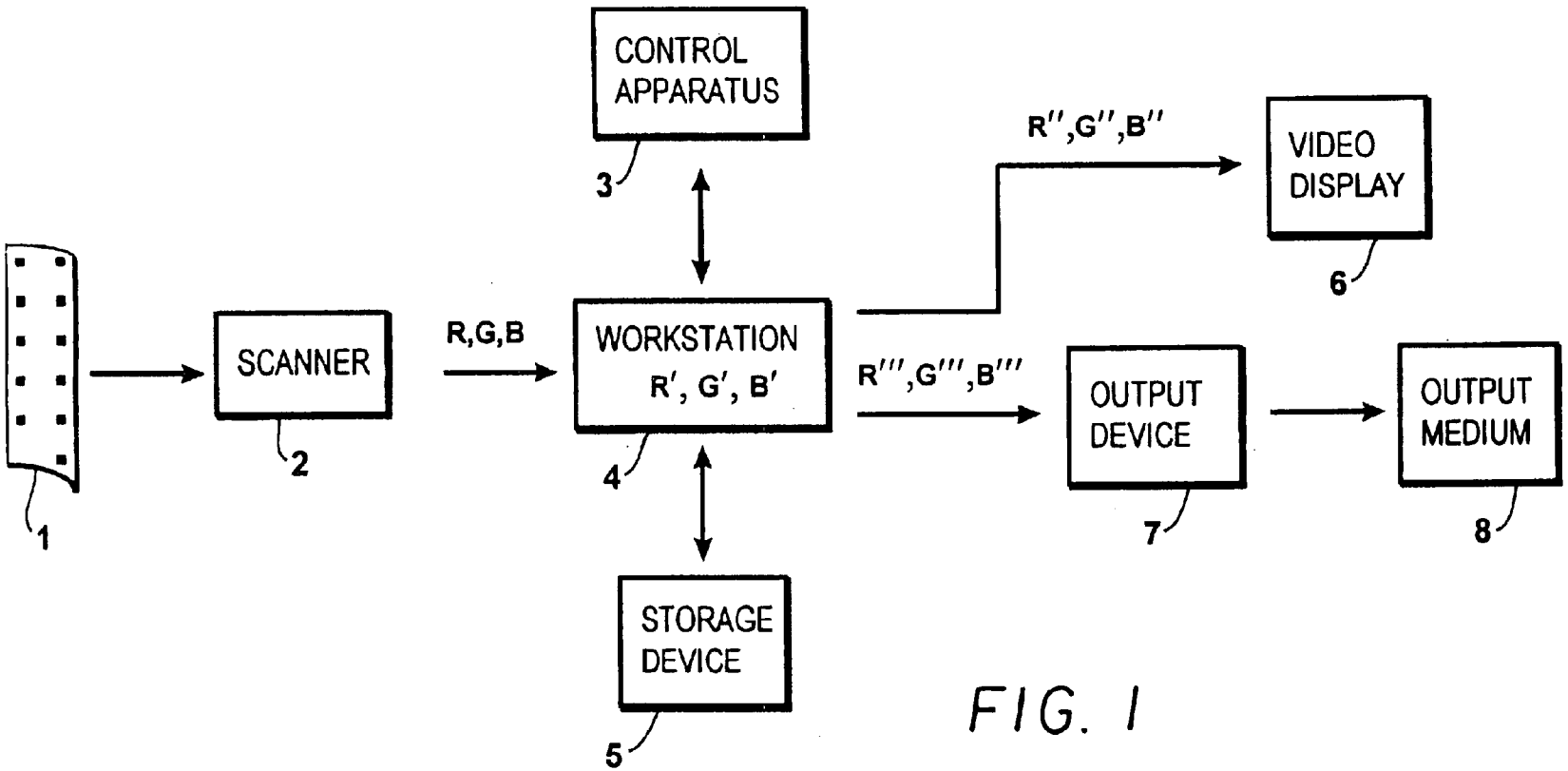
FIG. 1 shows in block diagram form an apparatus for processing and viewing image formation obtained by scanning the elements of the invention.

Preferably, the thermal solvents of our invention have a phenolic-OH group that is believed to function as a hydrogen bond donating functional group as a separate and distinct functional group in the same compound. By "phenolic" is meant that the —OH group is a substituent on an aromatic ring. In one embodiment of the invention, the thermal solvent also contains a hydrogen bond accepting functional group as a separate and distinct functional group in the same compound. In one embodiment, thermal solvents are provided according to Structure (I):

I

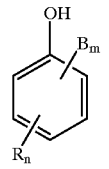

wherein the substituent B is independently selected from a substituent where an oxygen, carbon, nitrogen, phosphorus, or sulfur atom is linked to the ring as part of a ketone, aldehyde, ester, amido, carbamate, ether, aminosulfonyl, sulfamoyl, sulfonyl, amine (through —NH— or —NR—), phosphine (through —PH— or —$PR^2$—), or (preferably through a nitrogen atom) an aromatic heterocyclic group, where $R^2$ is defined below; m is 0 to 4; and wherein the substituent R is independently selected from a substituted or unsubstituted alkyl, cycloalkyl, aryl, alkylaryl, or forms a ring (for example, a substituted or unsubstituted: aliphatic ring, aryl ring or aromatic heterocyclic ring) with another substituent on the ring; and wherein n is 0 to 4 and m+n is 1 to 5.

Substituents on R or B can include any substituent that does not adversely affect the melt former or thermal solvent, for example, a halogen. The substituents R or B can also comprise another phenolic group.

The phenolic compound should have a melting point of at least 80° C., preferably 80° C. to 300° C., more preferably between 100 and 250° C. Preferably, m+n is 1 or 2. In one embodiment, when m is 0, there is a second phenolic group on an R substituent.

In a preferred class of compounds, in the compound of Structure I, B is selected from the group consisting of —C(=O)NHR$^2$, —NHC(=O)R$^2$, —NHSO$_2$R$^2$, —SO$_2$NHR$^2$, —SO$_2$R$^2$, and —C(=O)R$^2$, —C(=O)OR$^2$, and —OR$^2$, wherein R$^2$ is substituted or unsubstituted alkyl, cycloalkyl, aryl, alkylaryl, heterocyclic group and can optionally comprise a phenolic hydroxyl group. More preferably, n is 1 and R$^2$ is a substituted or unsubstituted phenyl. Preferably, any substituents on the phenyl group have 1 to 10 carbon atoms.

It is noted that in the case of two bulky alkyl (for example, tertiary C$_4$) substituents ortho to the phenolic group, melt-forming activity will be unsatisfactory. Therefore, compounds with two ortho C$_4$ groups and the like, not being effective melt formers, are excluded.

In general, it is desirable that water solubility of the compound is low enough that the melt former can be dispersed as an aqueous solid particle dispersion without recrystallization leading to ripening and loss of fine particles. Although not necessarily required, tendencies are such that preferably the clogP of the phenolic compounds is below 7.5, more preferably below 6.0.

The log of the partition coefficient, logP, characterizes the octanol/water partition equilibrium of the compound in question. Partition coefficients can be experimentally determined. As an estimate, clogP values can be calculated by fragment additivity relationships. These calculations are relatively simple for additional methylene unit in a hydrocarbon chain, but are more difficult in more complex structural variations. The clogP values used herein are estimated using KowWin® software from Syracuse Research Corporation, a not-for-profit organization, headquartered in Syracuse, N.Y. (USA).

In one preferred embodiment of the invention, the color photothermographic element comprises a radiation sensitive silver halide, and a thermal solvent represented by the following structure

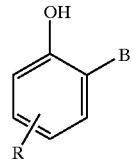

wherein B and R is as described above.

In one embodiment, the phenolic thermal solver ("melt former") has the following structure:

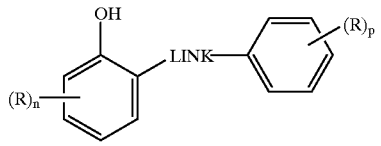

Wherein LINK can be —C(=O)NH—, —NHC(=O)—, —NHSO$_2$—, —C(=O)—, —C(=O)O—, —O—, —SO$_2$NH—, and —SO$_2$—; R and n are as defined above, and p is 0 to 4. Preferably R is independently selected from substituted or unsubstituted alkyl, preferably a C1 to C10 alkyl group. In one embodiment n and p are independently 0 or 1. In another embodiment, n+p=1.

Typically, the thermal solvent is present in an imaging layer of the photothermographic element in the amount of 0.01 times to 0.5 times the amount by weight of coated gelatin per square meter.

The following are some representative examples of melt formers according to the present invention:

MF-1
clogP
3.30
mp ° C.
136–138
87-17-2
ComA

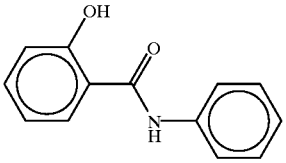

MF-2
clogP
3.84
mp ° C.
193–195
16670-64-7

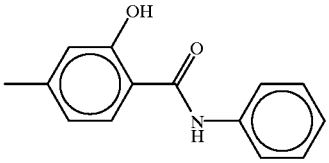

MF-3
clogP
7.26
mp ° C.
157–9

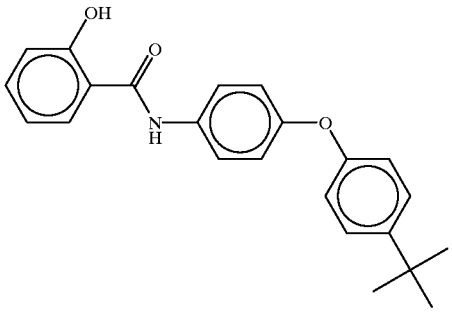

MF-4
clogP
4.47
mp ° C.
246–251
92-77-3
ComA

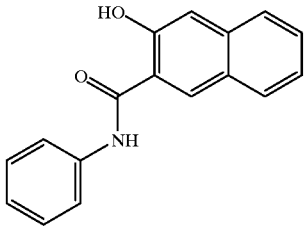

-continued
MF-5
clogP
5.06
mp ° C.
200–202
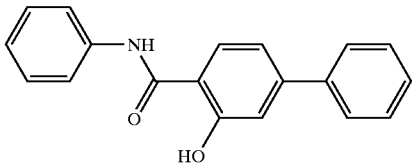
MF-6
clogP
3.84
mp ° C.
160
53938-41-3
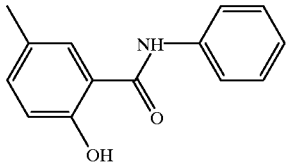
MF-7
clogP
3.84
mp ° C.
117
16670-62-5
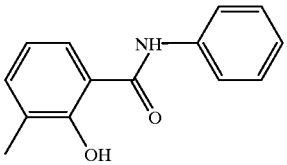
MF-8
ClogP
6.08
mp ° C.
224–226
3236-71-3
ComA
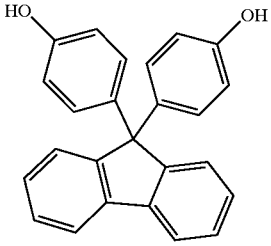
MF-9
clogP
3.64
mp ° C.
158–159
80-05-7
ComA
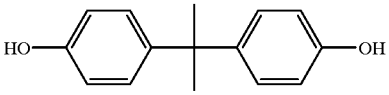
MF-10
clogP
4.27
mp ° C.
102
2549-50-0
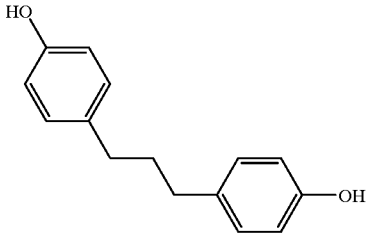
MF-11
clogP
3.33
mp ° C.
193
17177-36-5
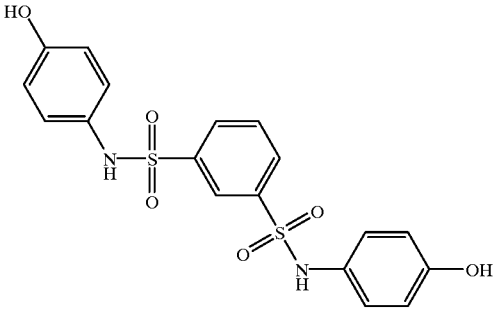
MF12
clogP
2.02
mp ° C.
120–123
96549-95-0
ComA
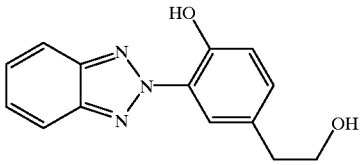
MF13
clogP
3.00
mp ° C.
128–133
2440-22-4
ComA
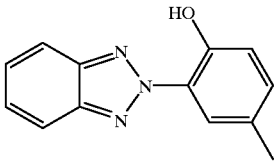
MF15
clogP
2.67
mp ° C.
132–135
1137-42-4
ComA
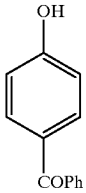

-continued

| | | | |
|---|---|---|---|
| MF16<br>clogP<br>3.30<br>mp ° C.<br>120–122<br>103-16-2 | 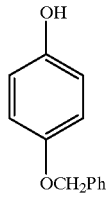 | MF17<br>clogP<br>2.22<br>mp ° C.<br>153<br>27559-45-1 | 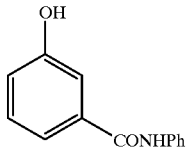 |
| MF18<br>clogP<br>5.00<br>mp ° C.<br>129–132<br>7260-11-9<br>ComA | 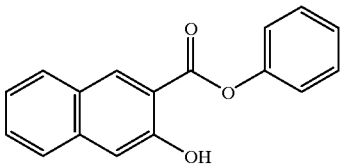 | MF19<br>clogP<br>0.18<br>mp ° C.<br>152–154<br>3077-65-4 | 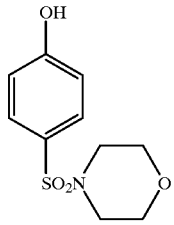 |
| MF20<br>clogP<br>2.38<br>mp ° C.<br>153–161<br>30988-95-5 | 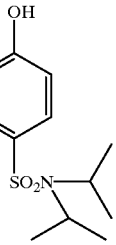 | MF21<br>clogP<br>1.79<br>mp ° C.<br>144–146<br>51110-60-2 | 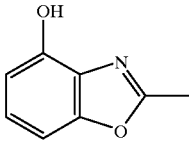 |
| MF22<br>clogP<br>3.87<br>mp ° C.<br>168–170 | 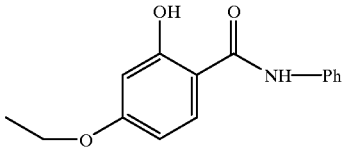 | | |

In the above Table, all the values of clogP values were calculated using SRC's LogKow® (KowWin®) software. CAS Registry Numbers are included when available. Also, indication of commercial availability (ComA=commercially available) is provided when known. Sources of commercially available compounds are Aldrich Chemical Company, Inc (Milwaukee, Wis. 53233); Acros Organics, at Janssen Pharmaceuticalaan 3a, B-2440, Geel, Belgium; and Trans World Chemicals Inc., 14674 Southlawn Lane, Rockville, Md. 20850.

As will be appreciated by the skilled artisan, many phenolic compounds according to the present invention may be made by simple reactions between appropriate intermediates, for example, melt former MF-2 can be prepared by treating 4-methyl salicylic acid with aniline. Methods for synthesizing phenolic compounds according to the present invention can be found in a variety of patent or literature references. For example, synthetic methods for making hydroxynaphthoic acid derivatives are disclosed by Ishida, Katsuhiko; Nojima, Masaharu; Yamamoto, Tamotsu; and Okamoto, Tosaku in Japanese Patent JP 61041595 A2 (1986) and JP 04003759 (1992) and Japanese Kokai JP 84-163718 (1984). Synthetic methods for making N-Substituted salicylamides are disclosed by Ciampa, Giuseppe and Grieco, Ciro., Univ. Naples, Rend. Accad. Sci. Fis. Mat. (Soc. Naz. Sci., Lett. Arti Napoli) (1966), 33(Dec.), 396–403.

Methods for the preparation of the anilides of phenolcarboxylic acids are disclosed by Burmistrov, S. I. and Limarenko, L. I., in U.S.S.R. Patent SU 189869 (1966) and Application SU 19660128. For example, anilides were prepared by treating phenolates with phenylurethane in a high-boiling organic solvent, e.g., cumene or the diethylbenzene fraction from the production of PhEt, with heating. Such a method can be used in the synthesis of melt former MF-2 above.

A Friedel-Crafts reaction, involving the synthesis of salicylanilides via ortho-aminocarbonylation of phenols with phenyl isocyanate can be used in the synthesis of melt former MF-6 and MF-7 above. Such a method is reported by Balduzzi, Gianluigi; Bigi, Franca; Casiraghi, Giovanni; Casnati, and Giuseppe; Sartori, Giovanni, Ist. Chim. Org., Univ. Parma, Parma, Italy, in the journal *Synthesis* (1982), (10), 879–81. For example, the reaction of "a" below with PhNCO in the presence of $AlCl_3$ in xylene gave "b," where R, $R^1$, $R^2$, $R^3$=H, H, H, H or Me, H, H, H or H, H, Me, H or H, MeO, H, H or H, H, MeO, H or H, Me, H, Me, or H, OH, H, H or H, H, $R^2R^3$=$(CH{:}CH)_2$.

a

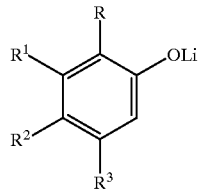

b

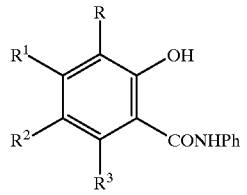

Iwakura, Ken and Igarashi, Akira, in Japanese Patent JP 62027172 A2 (1987) and Kokai JP 1985-165514 (1985) disclose a method of making a 1,3-bis(4-hydroxyphenyl) propane, which method can be used, for example, in the preparation of melt-former MF-10 and the like. The preparation of benzimidazoles and analogs is disclosed by Oku, Teruo; Kayakiri, Hiroshi; Satoh, Shigeki; Abe, Yoshito; Sawada, Yuki; Inoue, Takayuki; and Tanaka, Hirokazu, in PCT Int. Appl. WO 9604251 A1 (1996) and WO 95-JP1478 (1995). Such methods can be used in preparing, for example, the melt former MP-21 above.

Methods of preparing bisphenol compounds are disclosed in Japanese Patent JP 56108759 A2 (1981) and Application: JP 80-8234 (1980). For example, bisphenol disulfonamides were prepared from bis(benzotriazolyl sulfonates). Thus, in one case, bis(1-benzotriazolyl) diphenyl ether-4,4'-disulfonate was added to 4-$H_2NC_6H_4OH$ in pyridine with ice cooling and the mixture stirred 24 hours at room temperature to give N'-bis(p-hydroxyphenyl)diphenyl ether-4, 4'-disulfonamide. Such methods can be used, for example, to make melt former MF-11 above and the like.

The heat-processible photographic material of the present invention contains (a) a light-sensitive silver halide, (b) a reducing agent, (c) a binder and (d) a melt-forming material of the present invention. Preferably, it further contains (e) an effective amount of silver donor or non-light-sensitive organic silver compound or salt as required. Preferably, it further contains (f) a dye-forming compound or coupling agent. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sub-layers and components (a), (b), (c) and (e) are incorporated in one sub-layer with the dye-providing material (d) being incorporated in the other sub-layer which is adjacent to the first sub-layer. The heat-processible light-sensitive layer may be divided into two or more layers including a highly sensitive layer and a less sensitive layer, or a high-density layer and a low-density layer.

The heat-processible photographic material of the present invention has one or more heat-processible light sensitive layers on a base support, some or all of which layers and sublayers may contain a melt former. If it is to be used as a full-color light-sensitive material, the heat-processible photographic material of the invention generally has three heat-processible light-sensitive dye-forming layer units comprising one or more layers varying in the degree of sensitivity to light, each layer unit having different color sensitivities, each light-sensitive layer unit forming or releasing a dye of different color as a result of thermal development. A blue-sensitive layer in a unit is usually combined with a yellow dye, a green-sensitive layer with a magenta dye, and a red-sensitive layer with a cyan dye, but a different combination may be used.

The choice of layer unit arrangements depends on the objective of a specific use. For instance, a base support is coated with a red-sensitive, a green-sensitive and a blue-sensitive layer unit, or in the reverse order (i.e., a blue-sensitive, a green-sensitive and a red-sensitive layer unit), or the support may be coated with a green-sensitive, a red-sensitive and a blue-sensitive layer unit.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layers and these non-light-sensitive layers may be applied to a base support by coating techniques that are similar to those commonly employed to coat and prepare ordinary silver halide photographic materials.

The heat-processible photographic material of the present invention permits the use of a variety of known heating techniques. All methods of heating that can be used with ordinary heat-processible photographic materials may be applied to the heat-processible photographic material of the present invention. In one instance, the photographic material may be brought into contact with a heated block or plate, or with heated rollers or a hot drum. Alternatively, the material may be passed through a hot atmosphere. High-frequency heating is also applicable. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. A simple heating pattern is preferred. If desired, exposure and heating may proceed simultaneously.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND, U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND. Further improvements in blocked developers are disclosed in U.S. Ser. No. 09/710,341, U.S. Ser. No. 09/718,014, U.S. Ser. No. 09/711,769, U.S. Ser. No. 09/711,548, and U.S. Ser. No. 09/710,348. Yet other improvements in blocked developers and their use in photothermographic elements are found in commonly assigned copending applications, filed concurrently herewith, U.S. Ser. No. 09/718,027 and U.S. Ser. No. 09/717,42.

In one embodiment of the invention, the blocked developer may be represented by the following Structure II:

$$\text{DEV—(LINK 1)}_l\text{—(TIME)}_m\text{—(LINK 2)}_n\text{—K} \qquad \text{II}$$

wherein,

DEV is a silver-halide color developing agent;

LINK 1 and LINK 2 are linking groups;

TIME is a timing group;

l is 0 or 1;

m is 0, 1, or 2;

n is 0 or 1;

l+n is 1 or 2;

K is a blocking group or K is:

$$\text{—K'—(LINK 2)}_n\text{—(TIME)}_m\text{—(LINK 1)}_l\text{—DEV}$$

wherein K' also blocks a second developing agent DEV.

In a preferred embodiment of the invention, LINK 1 or LINK 2 are independently of Structure III:

III

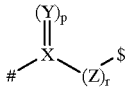

wherein

X represents carbon or sulfur;

Y represents oxygen, sulfur or N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

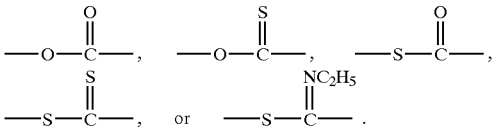

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

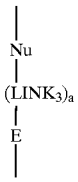

wherein:

Nu is a nucleophilic group;

E is an electrophilic group comprising one or more carbo- or hetero- aromatic rings, containing an electron deficient carbon atom;

LINK 3 is a linking group that provides 1 to 5 atoms in the direct path between the nucleopnilic site of Nu and the electron deficient carbon atom in E; and a is 0 or 1.

Such timing groups include, for example:

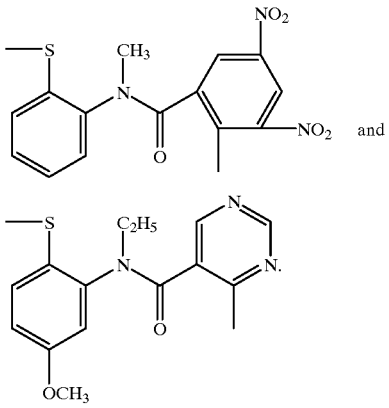

These timing groups are described more fully in U.S. Pat. No. 5,262,291, incorporated herein by reference.

T-2

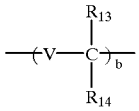

wherein

V represents an oxygen atom, a sulfur atom, or an

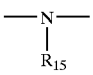

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include $R_{16}$—, $R_{17}CO$—, $R_{17}SO_2$—, $R_{16}NCO$— and $R_{16}NSO_2$— where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

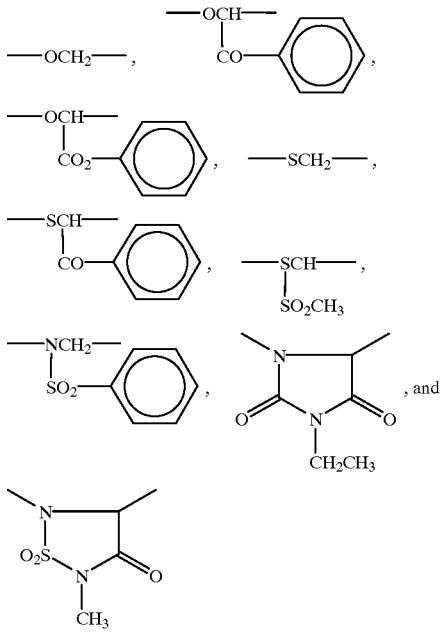

—Nu1—LINK4—E1 T-3 wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

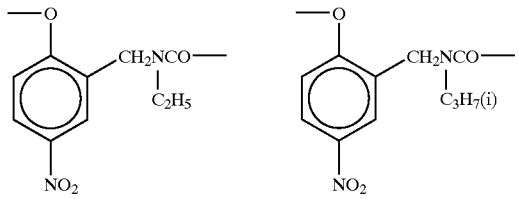

-continued

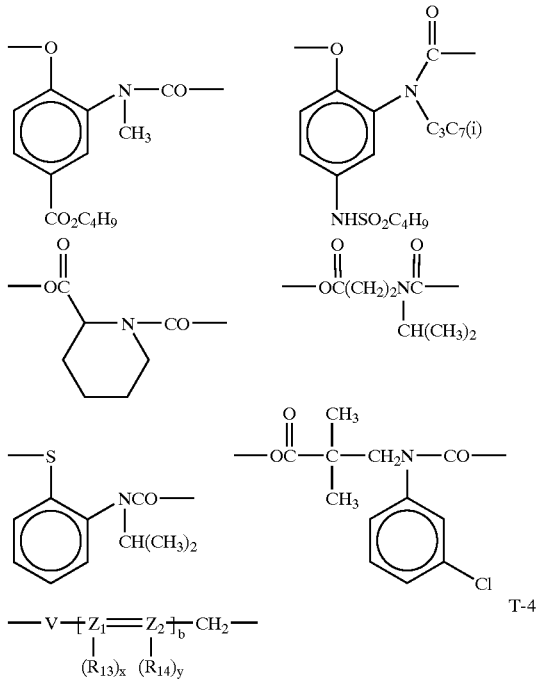

T-4 wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

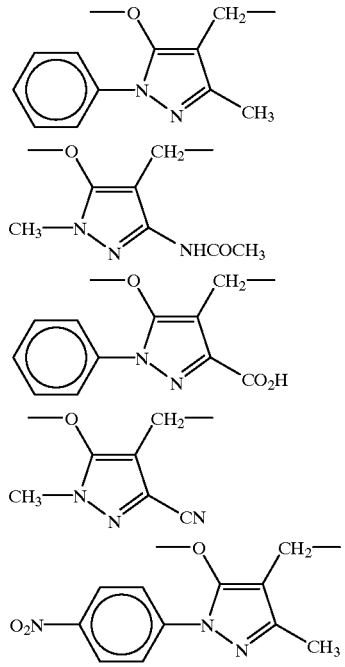

-continued

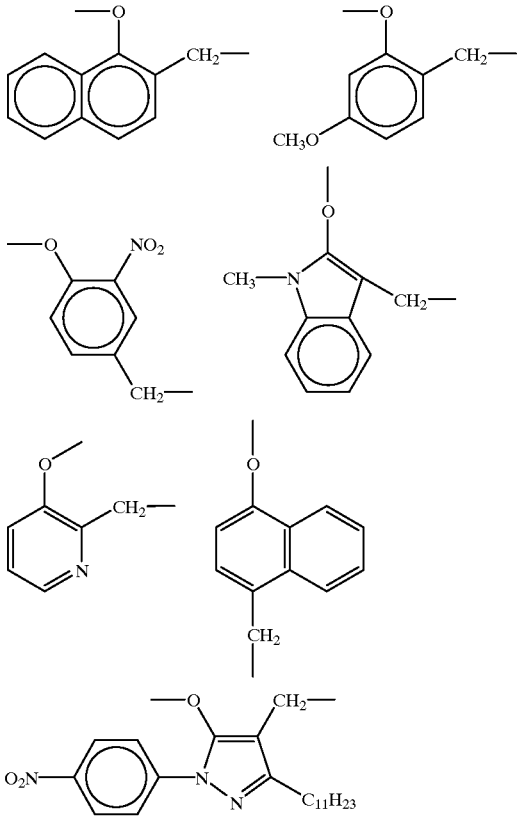

Illustrative developing agents that can be released by the blocked developers are:

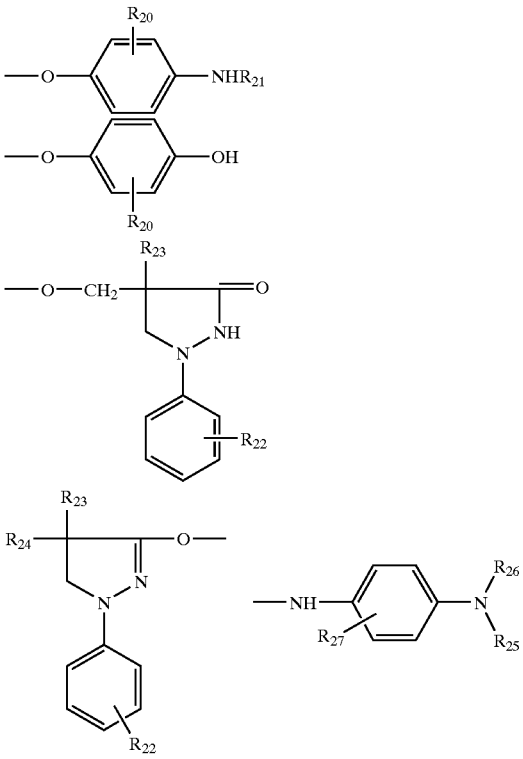

-continued

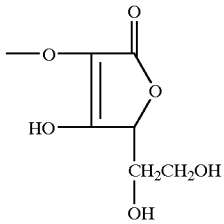

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

Preferably, the color photothermographic element according to one embodiment of the present invention comprises a blocked developer having a half life of less than or equal to 20 minutes and a peak discrimination, at a temperature of at least 60° C., of at least 2.0, which blocked developer is represented by the following Structure IV:

IV

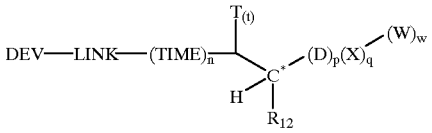

wherein:

DEV is a developing agent;

LINK is a linking group as defined above for LINK1 or LINK2;

TIME is a timing group as defined above;

n is 0, 1, or 2;

t is 0, 1, or 2, and when t is not 2, the necessary number of hydrogens (2−t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group.

Preferably, T is an inorganic group such as halogen, —$NO_2$, —CN; a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, $OCOR_{13}$, —$CO_2R_{13}$, —$COR_{13}$, —$NR_{14}(COR_{13})$, etc. A particularly preferred T group is an aryl group substituted with one to seven electron withdrawing groups.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any tetrahedral carbon atoms except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(OR_{15})N(R_{16})$—, and the like, in which the atoms in the backbone of the X group (in a direct line between the C* and W) are not attached to any hydrogen atoms.

W is W' or a group represented by the following Structure IVA:

IVA

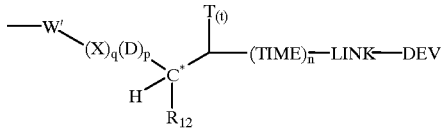

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IVA, W' comprises a least one substituent, namely the moiety to the right of the W' group in Structure IVA, which substituent is by definition activating, comprising either X or D);

W is an activating group when W has structure IVA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, or —CN; or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, —$OCOR_{13}$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group. Any two members (which are not directly linked) of the following set: $R_{12}$, T, and either D or W, may be joined to form a ring, provided that creation of the ring will not interfere with the functioning of the blocking group.

In one embodiment of the invention, the blocked developer is selected from Structure IV with the proviso that when t is 0, then D is not —CN or substituted or unsubstituted aryl and X is not —$SO_2$— when W is substituted or unsubstituted aryl or alkyl; and when t is not an activating group, then X is not —$SO_2$— when W is a substituted or unsubstituted aryl.

In the above Structure IV, the T, $R_{12}$, X or D, W groups are preferably selected such that the blocked developer exhibits a half life of less than or equal to 20 minutes (as determined in the Examples) and a peak discrimination, at a temperature of at least 60° C., of at least 2.0. The specified half-life can be obtained by the use of activating groups in certain positions in the blocking moiety of the blocked developer of Structure IV. More specifically, it has been found that the specified half-life can be obtained by the use of activating groups in the D or X position. Further activation to achieve the specified half-life may be obtained by the use of activating groups in one or more of the T and/or W positions in Structure IV. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, in addition to D or X, in at least one of the T or W groups.

By the term inorganic is herein meant a group not containing carbon excepting carbonates, cyanides, and cyanates. The term heterocyclic herein includes aromatic and non-aromatic rings containing at least one (preferably 1 to 3) heteroatoms in the ring. If the named groups for a symbol such as T in Structure IV apparently overlap, the narrower named group is excluded from the broader named group solely to avoid any such apparent overlap. Thus, for example, heteroaromatic groups in the definition of T may be electron withdrawing in nature, but are not included under monovalent or divalent electron withdrawing groups as they are defined herein.

It has further been found that the necessary half-life can be obtained by the use of activating groups in the D or X position, with further activation as necessary to achieve the necessary half-life by the use of electron withdrawing or heteroaromatic groups in the T and/or W positions in Structure IV. By the term activating groups is meant electron withdrawing groups, heteroaromatic groups, or aryl groups substituted with one or more electron withdrawing groups. Preferably, in addition to D or X, at least one of T or W is an activating group.

When referring to electron withdrawing groups, this can be indicated or estimated by the Hammett substituent constants ($\sigma_p$, $\sigma_m$), as described by L. P. Hammett in Physical Organic Chemistry (McGraw-Hill Book Co., NY, 1940), or by the Taft polar substituent constants ($\sigma_I$) as defined by R. W. Taft in Steric Effects in Organic Chemistry (Wiley and Sons, NY, 1956), and in other standard organic textbooks. The $\sigma_p$ and $\sigma_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\sigma_p$ and $\sigma_m$ are widely available in the chemical literature, as for example in C. Hansch et al., J. Med. Chem., 17, 1207 (1973). For substituents attached to a tetrahedral carbon instead of aryl groups, the inductive substituent constant $\sigma_I$ is herein used to characterize the electronic property. Preferably, an electron withdrawing group on an aryl ring has a $\sigma_p$ or $\sigma_m$ of greater than zero, more preferably greater than 0.05, most preferably greater than 0.1. The $\sigma_p$ is used to define electron withdrawing groups on aryl groups when the substituent is neither para nor meta. Similarly, an electron withdrawing group on a tetrahedral carbon preferably has a $\sigma_I$ of greater than zero, more preferably greater than 0.05, and most preferably greater than 0.1. In the event of a divalent group such as —$SO_2$—, the $\sigma_I$ used is for the methyl substituted analogue such as —$SO_2CH_3$ ($\sigma_I$=0.59). When more than one electron withdrawing group is present, then the summation of the substituent constants is used to estimate or characterize the total effect of the substituents.

More preferably, the blocked developers used in the present invention is within Structure IV above, but represented by the following narrower Structure V:

Structure V

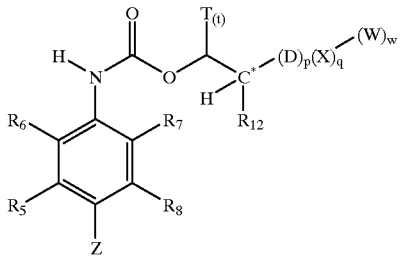

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following Structure VA:

Structure VA

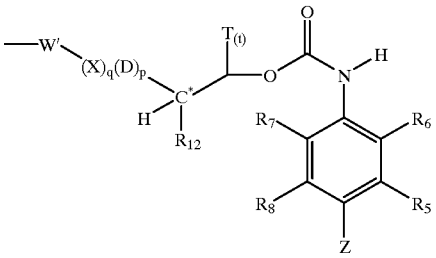

wherein T, t, C*, $R_{12}$, D, p, X, q, W' and w are as defined above, including, but not limited to, the preferred groups.

Again, the present invention includes photothermographic elements comprising blocked developers according to Structure IV which blocked developers have a half-life $(t_{1/2}) \leqq 20$ min (as determined below).

When referring to heteroaromatic groups or substituents, the heteroaromatic group is preferably a 5- or 6-membered ring containing one or more hetero atoms, such as N, O, S or Se. Preferably, the heteroaromatic group comprises a substituted or unsubstituted benzimidazolyl, benzothiazolyl, benzoxazolyl, benzothienyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thienyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-,4-, or 5-pyrazolyl, 3-indazolyl, 2- and 3-thienyl, 2-(1,3,4-triazolyl), 4-or 5-(1,2,3-triazolyl), 5-(1,2,3,4-tetrazolyl). The heterocyclic group may be further substituted. Preferred substituents are alkyl and alkoxy groups containing 1 to 6 carbon atoms.

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Cycloalkyl when appropriate includes bicycloalkyl. Further, with regard to any alkyl group or alkylene group, it will be understood that these can be branched, unbranched, or cyclic.

The following are representative examples of photographically useful blocked developers for use in the invention:

D-1

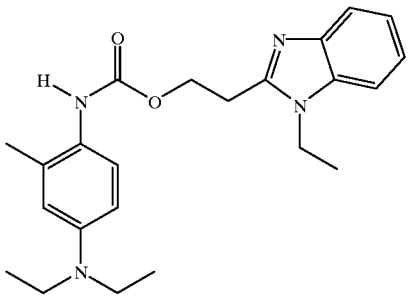

D-2

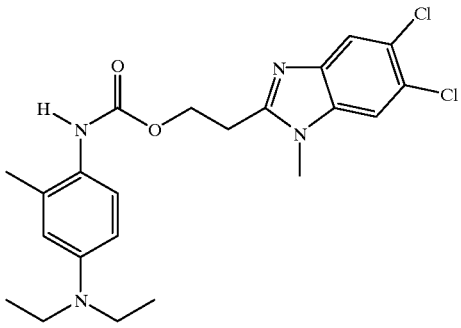

-continued
D-3
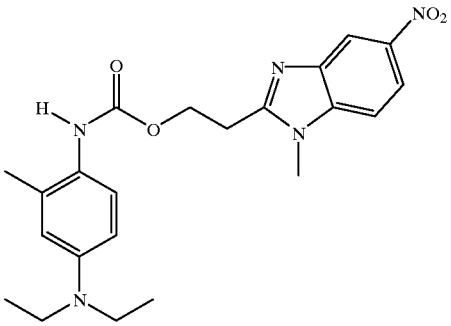
D-4
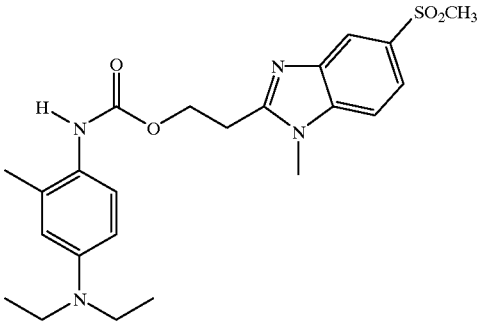
D-5
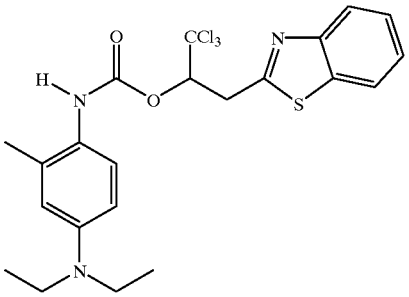
D-6
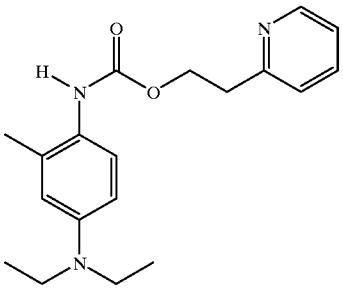
D-7
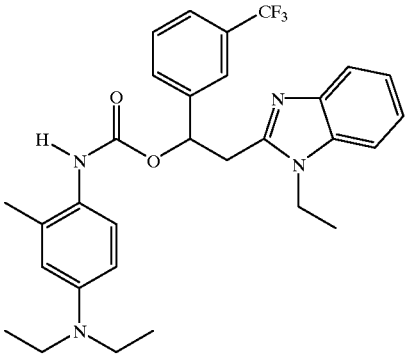
-continued
D-8
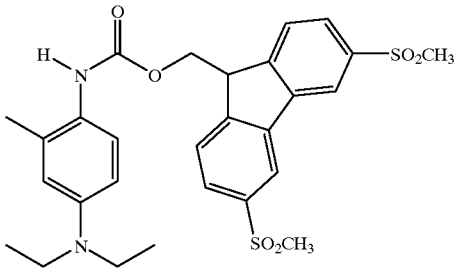
D-9
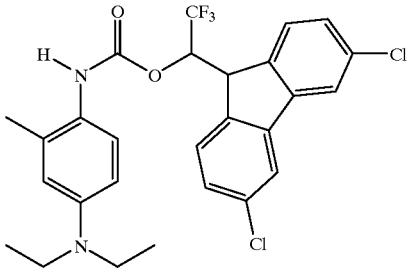
D-10
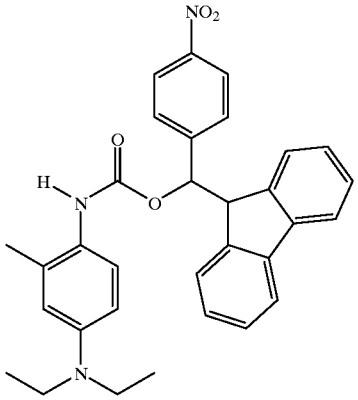
D-11
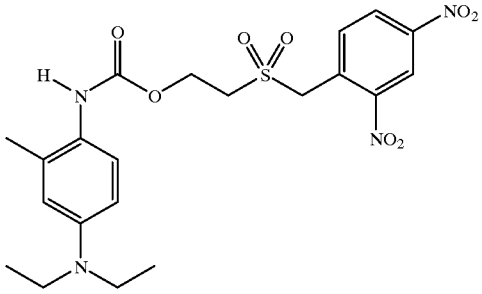
D-12
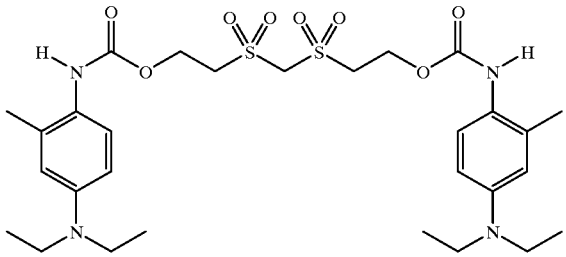

-continued
D-13
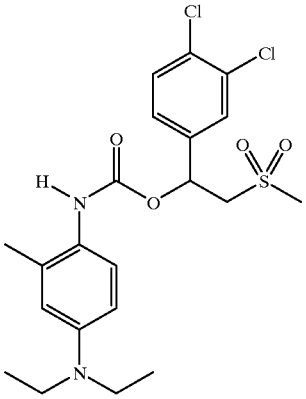
D-14
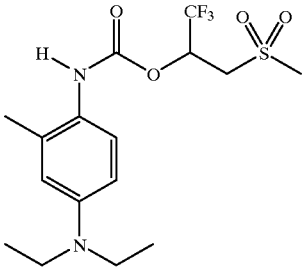
D-15
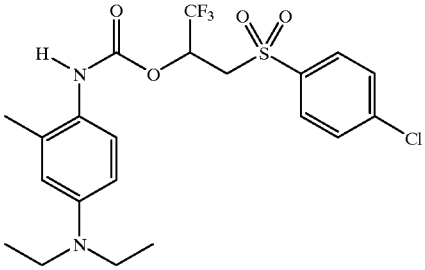
D-16
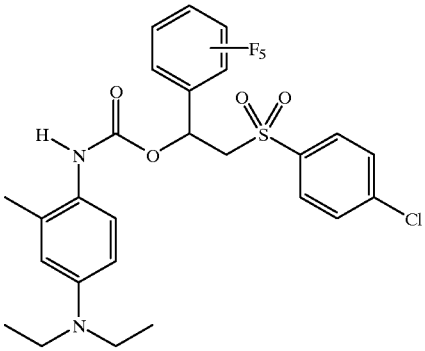
D-17
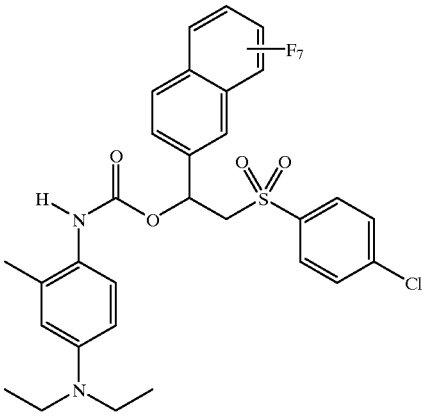
-continued
D-18
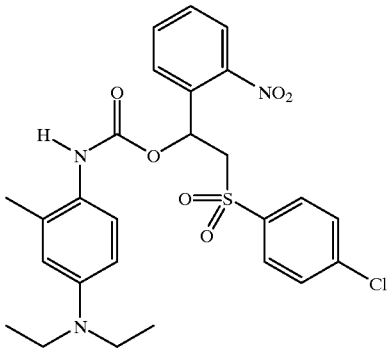
D-19
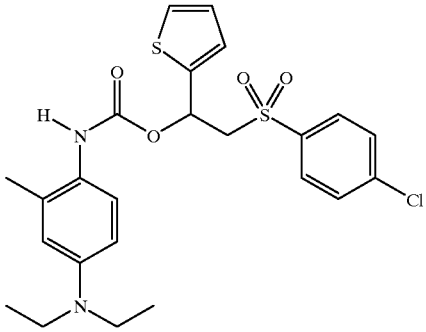
D-20
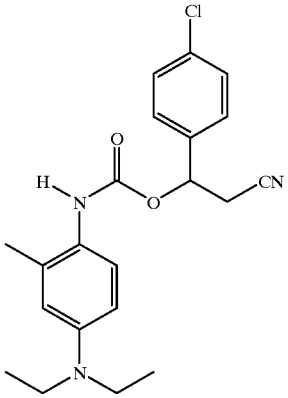
D-21
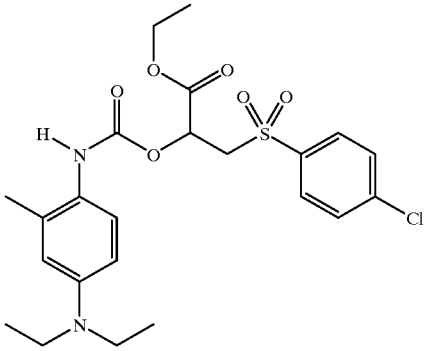
D-22
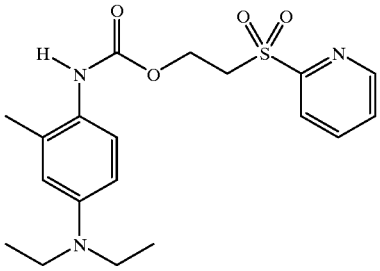

-continued
D-23
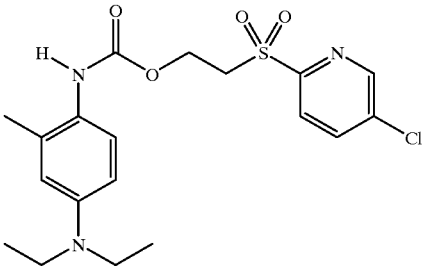
D-24
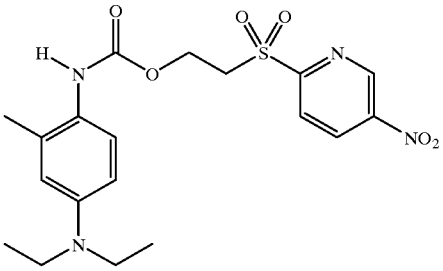
D-25
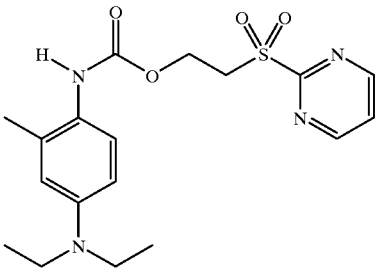
D-26
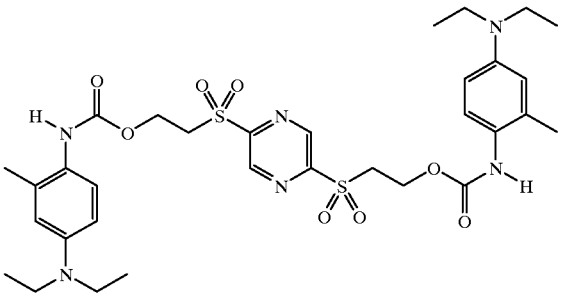
D-27
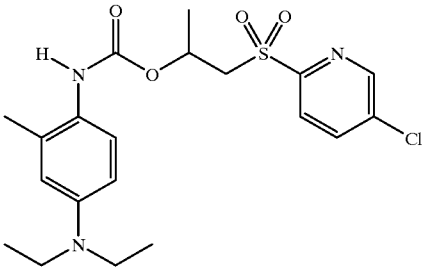
-continued
D-28
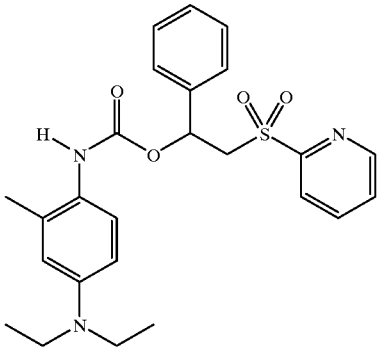
D-29
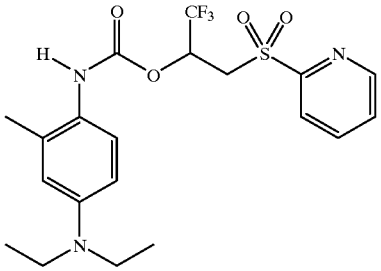
D-30
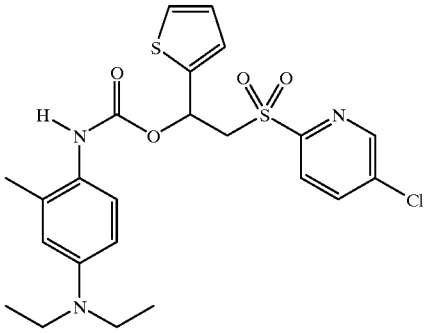
D-31
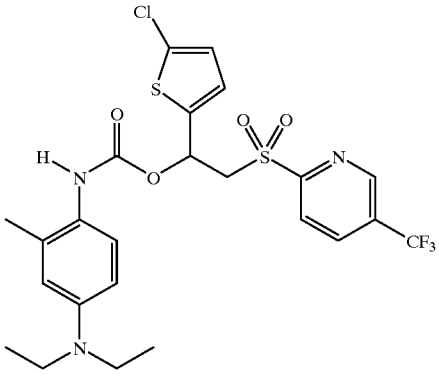
D-32
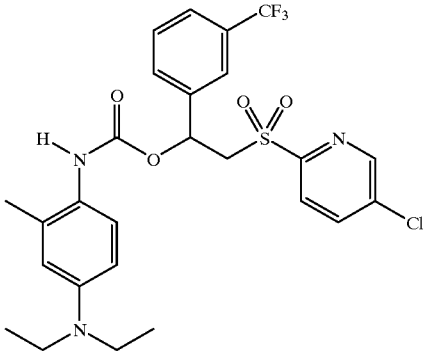

-continued
D-33
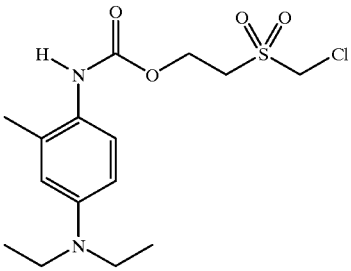
D-34
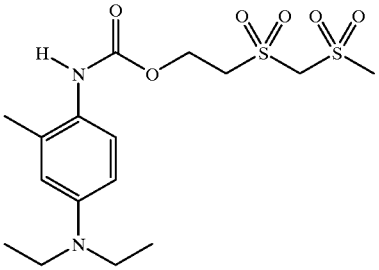
D-35
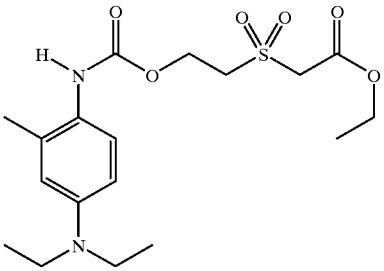
D-36
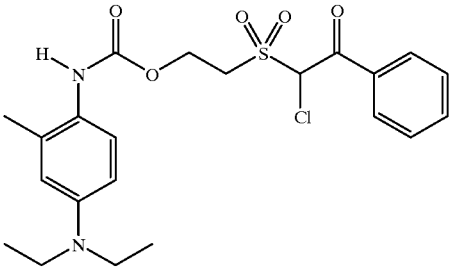
D-37
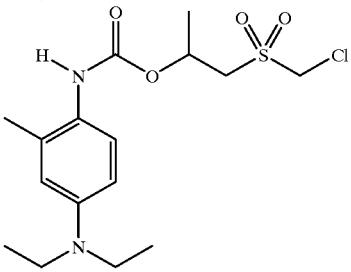
D-38
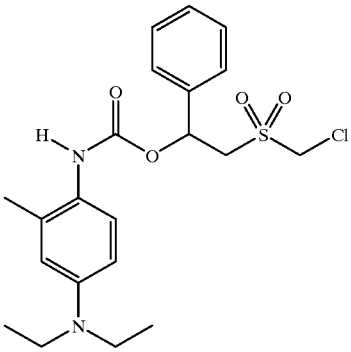
-continued
D-39
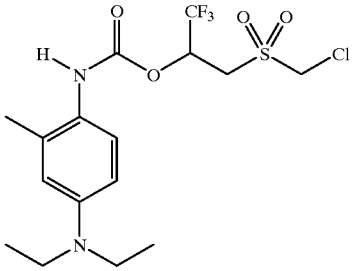
D-40
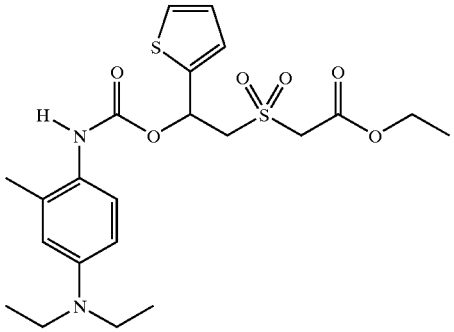
D-41
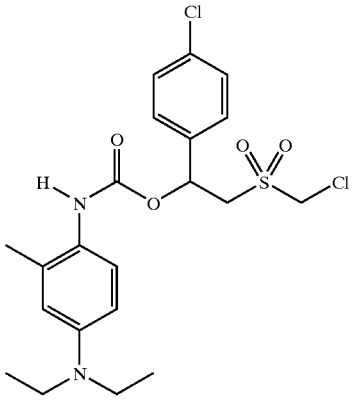
D-42
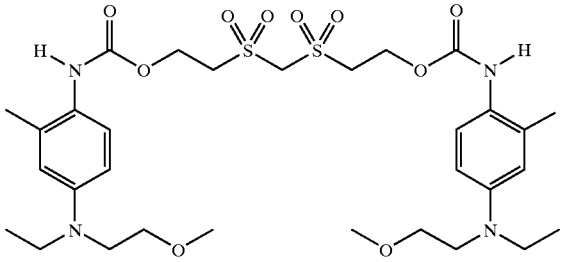
D-43
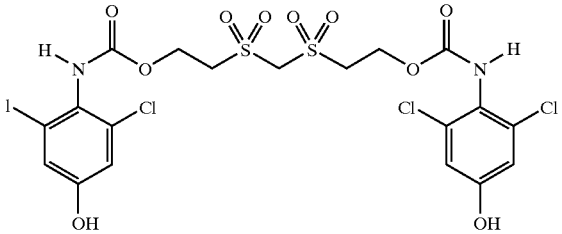

-continued

D-44

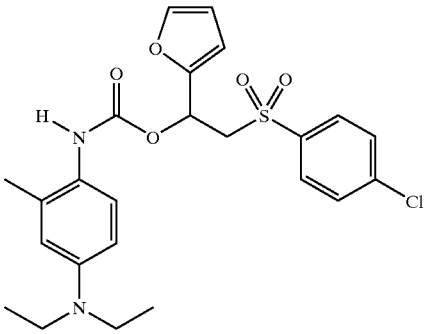

D-45

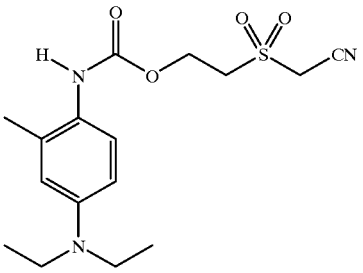

D-46

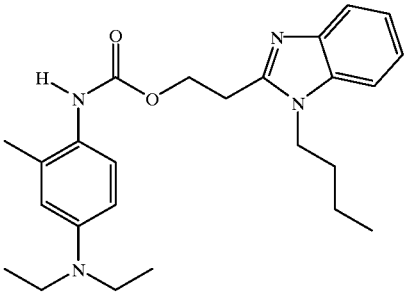

To determine the half life ($t_{1/2}$) or thermal activity of blocked developers, except for blocked developers in which a heteroaromatic D group in Structure IV is present (see below), the blocked developers can be tested for thermal activity as follows: The blocked developer is dissolved at a concentration of ~$1.6\times10^{-5}$ M in a solution consisting of 33% (v/v) EtOH in deionized water at 60° C. and pH 7.87 and ionic strength 0.125 in the presence of Coupler-1 (0.0004 M) and $K_3Fe(CN)_6$ (0.00036 M). The reaction is followed by measurement of the magenta dye formed at 568 nm with a spectrophotometer (for example, a HEWLETT PACKARD 8451A Spectrophotometer or an equivalent). The reaction rate constant (k) is obtained from a fit of the following equation to the data:

$$A=A_0+A_\infty(1-e^{-kt})$$

where A is the absorbance at 568 nm at time t, and the subscripts denote time 0 and infinity (∞). The half-lives are calculated accordingly from $t_{1/2}=0.693/k$.

Coupler-1

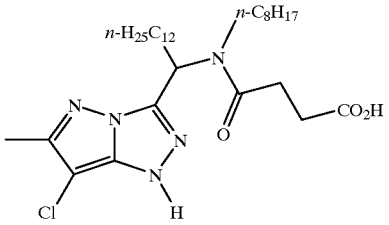

To determine the half-lives of blocked developing agents of Structure IV in which D is a heteroaromatic group, the blocked developer was dissolved at a concentration of ~$1.0\times10^{-4}$ M in a solution consisting dimethylsulfoxide (DMSO) solvent at 130° C. in the presence of 0.05 M of salicylanilide, which was first mixed with the DMSO solvent. The reaction kinetics was followed by high pressure liquid chromatography (HPLC) analysis of the reaction mixture, for example using a Hewlett-Packard LC 1100 System or an equivalent.

The blocked developer is preferably incorporated in one or more of the imaging layers of the imaging element. The amount of blocked developer used is preferably 0.01 to 5 $g/m^2$, more preferably 0.1 to $2g/m^2$ and most preferably 0.3 to 2 $g/m^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The blocked compounds may be used in any form of photographic system. A typical color negative film construction useful in the practice of the invention is illustrated by the following element, SCN-1:

| ELEMENT SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure* I.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure* I, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable fall recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometly, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The blocked compounds of this invention may be used in photographic elements that contain any or all of the features discussed above, but are intended for different forms of processing. These types of systems will be described in detail below.

Type I: Thermal process systems (thermographic and photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing.

Types I and II will now be discussed in turn.

Type I: Thermographic and Photothermographic Systems

In accordance with one aspect of this invention the blocked developer is incorporated in a photothermographic element. Photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A reducing agent in addition to the blocked developer may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfonamidophenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl)propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a toning agent, also known as an activator-toner or toner-accelerator. (These may also function as thermal solvents or melt formers.) Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Plior-art thermal solvents are disclosed, for example, in U.S. Pat. No. 6,013,420 to Windender.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacryilate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In accordance with one aspect of this invention the blocked developer is incorporated in a thermographic element. In thermographic elements an image is formed by imagewise heating the element. Such elements are described in, for example, *Research Disclosure*, June 1978, Item No. 17029 and U.S. Pat. Nos. 3,080,254, 3,457,075 and 3,933,508, the disclosures or which are incorporated herein by reference. The thermal energy source and means for imaging can be any imagewise thermal exposure source and means that are known in the thermographic imaging art. The thermographic imaging means can be, for example, an infrared heating means, laser, microwave heating means or the like.

Type II: Low Volume Processing:

In accordance with another aspect of this invention the blocked developer is incorporated in a photographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

Nevertheless, since the retained silver halide can scatter light, decrease sharpness and raise the overall density of the film. Retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render the PTG film to an archival state.

Furthermore, the silver coated in the PTG film (silver halide, silver donor, and metallic silver) is unnecessary to the dye image produced, and this silver is valuable and the desire to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical, as will be familiar to those skilled in the photographic arts. This chemical has the ability to form a soluble complex with silver ion and transport the silver out of the film into a receiving vehicle. The receiving vehicle can be another coated layer (laminate) or a conventional liquid processing bath. Laminates useful for fixing films are disclosed in the prior art. Automated systems for applying a photochemical processing solution to a film via a laminate are disclosed, for example, in commonly assigned U.S. Ser. No. 09/593,097.

The stabilization of the silver halide and silver donor can also be accomplished with a common stabilization chemical as known to those skilled in the art. This chemical has the ability to form a reactively stable and light-insensitive compound with silver ion. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning. The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. Steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of PTG film processes involving a common dry heat development step are as follows:

1. heat development=>scan=>stabilize (for example, with a laminate)=>scan=>obtain returnable archival film.
2. heat development=>fix bath=>water wash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>scan=>blix bath=>wash=>fix bath=>wash=>dry=>obtain returnable archival film
6. heat development=>relatively rapid, low quality scan
7. heat development=>bleach=>wash=>fix=>wash=>dry=>relatively slow, high quality scan It is also possible to have PTG films capable of being consecutively/sequentially processed by dry thermal development and then by a traditional wet-chemical process such as all or part of a commercial C-41 (or equivalent) process (it is also possible to have the films alternatively backwards compatible, as discussed above, and sequentially compatible). For example such processes, and particularly the C-41 process, has a bleach and fix tail end that is very effective for removing silver from coatings. However, since all trade processors are set up with development as the first step, if a PTG film has already been developed by heat, then a second development through the C-41 process would destroy the PTG image by over-development. In order to use a C-41 process for post-development procesing of a dry PTG film, for example as a remediation step for PTG films, the C-41 process can be reconfigured by removing the development stage. Alternatively, to minimize cost and simplify operations, a PTG film can be designed to be both backwards compatible and sequentially dual processable whereby silver is remediated through the complete C-41 trade process without modification after thermal development has already occurred. The additional capability this provides is more clearly outlined by the following processing schemes:

1) heat development=>rapid, low quality scan=>C-41 process=>slow, high quality scan The latter process can be accomplished by the use of a blocked inhibitor that is released upon thermal development. This inhibitor has a weak effect in dry physical development, so development proceeds in the usual manner. The C-41 process does not have the capability to release the inhibitor, so development also proceeds in the usual manner. However, when thermal development (and concomitant release of the inhibitor) preceeds the C-41 process, the effect in the wet process is such that no development occurs. This process in disclosed in commonly assigned U.S. Ser. No. 60/211,446. Examples of such blocked compounds follow.

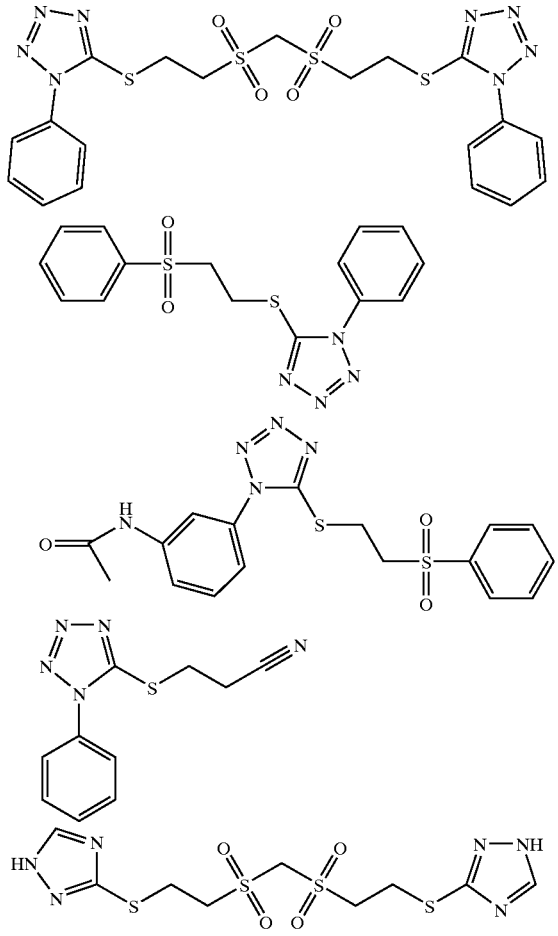

The Type II photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records-red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
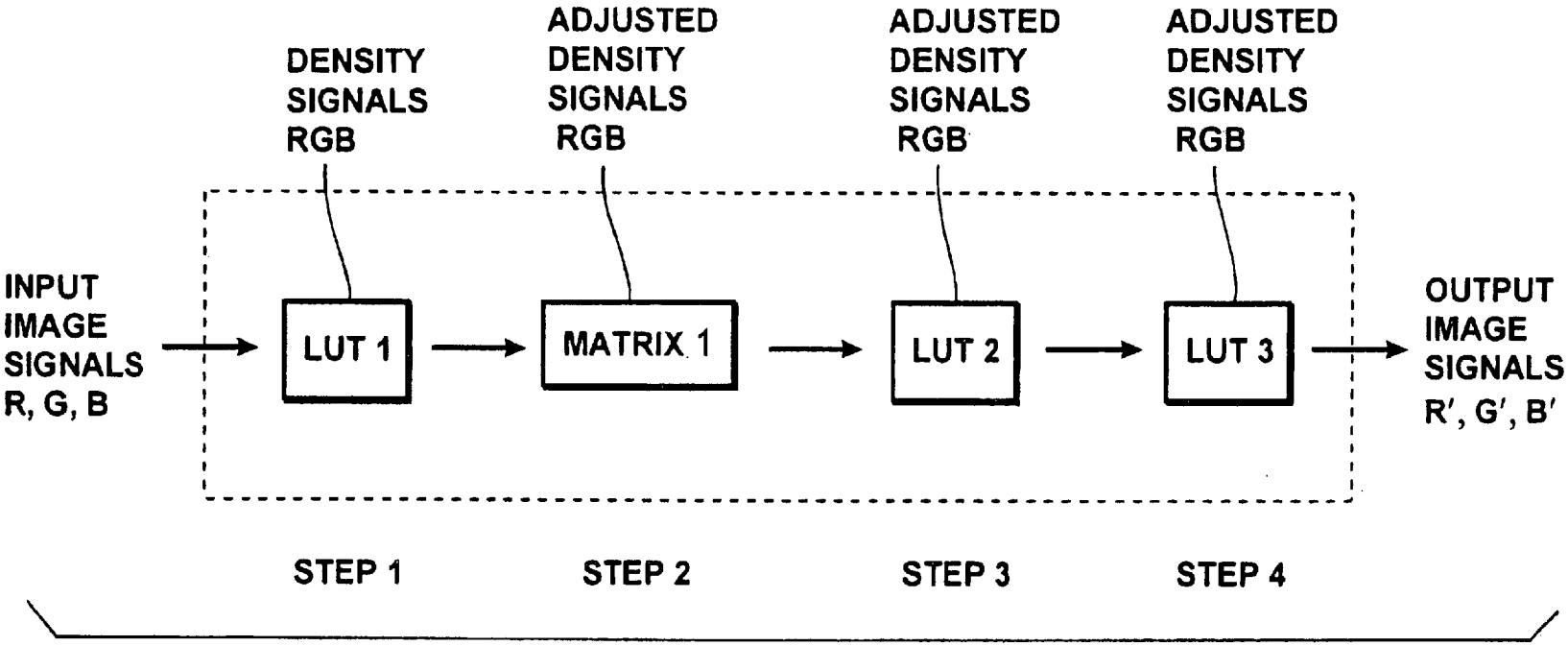
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

In yet another embodiment of the invention, the luminance and chrominance sensitization and image extraction article and method described by Arakawa et al in U.S. Pat. No. 5,962,205 can be employed. The disclosures of Arakawa et al are incorporated by reference.

PHOTOGRAPHIC EXAMPLES

Processing conditions are as described in the examples. Unless otherwise stated, the silver halide was removed after development by immersion in Kodak Flexicolor Fix solution. In general, an increase of approximately 0.2 in the measured density would be obtained by omission of this step.

Example 1

The inventive coating examples were prepared according the coating format of Table 1 below on a 7 mil thick poly(ethylene terephthalate) support and comprised an emulsion containing layer (contents shown below) with an overcoat layer of gelatin (0.22 g/m$^2$) and 1,1'-(methylenebis (sulfonyl))bis-ethene hardener (at 2% of the total gelatin concentration). Both layers contained spreading aids to facilitate coating.

TABLE 1

| Component | Laydown |
|---|---|
| Silver (from emulsion E-1) | 0.54 g/m$^2$ |
| Silver (from silver salt SS-1) | 0.32 g/m$^2$ |
| Silver (from silver salt SS-2) | 0.32 g/m$^2$ |
| Coupler M-1 (from coupler dispersion Disp-1) | 0.54 g/m$^2$ |
| Developer Dev-1 | 0.86 g/m$^2$ |
| Melt Former | Equimolar to salicylanilide at 0.86 g/m$^2$ |
| Lime-processed gelatin | 4.3 g/m$^2$ |

Common Components

Silver Salt Dispersion SS-1:

A stirred reaction vessel was charged with 431 g of lime-processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion SS-2:

A stirred reaction vessel was charged with 431 g of lime-processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsions: The silver halide emulsion was prepared by conventional means to have the following morphology and composition. The emulsion was spectrally sensitized to green light by addition of sensitizing dyes and then chemically sensitized for optimum performance.

E-1: a tabular emulsion with composition of 96% silver bromide and 4% silver iodide and an equivalent circular diameter of 1.2 microns and a thickness of 0.12 microns.

Melt Former Dispersion:

A dispersion of salicylanilide was prepared by the method of ball milling. To a total 20 g sample was added 3.0 g salicylanilide solid, 0.20 g poly(vinyl pyrrolidone), 0.20 g TRITON X-200 surfactant, 1.0 g gelatin, 15.6 g distilled water, and 20 ml of zirconia beads. The slurry was ball milled for 48 hours. Following milling, the zirconia beads were removed by filtration. The slurry was refrigerated prior to use. For preparations on a larger scale, the salicylanilide was media-milled to give a final dispersion containing 30% Salicylanilide, with 4% TRITON X-200 surfactant and 4% poly(vinyl pyrrolidone) added relative to the weight of salicylanilide. In some cases the dispersion was diluted with water to 25% salicylanilide or gelatin (5% of total) was added and the concentration of Salicylanilide adjusted to 25%. If gelatin is added, biocide (KATHON) is also added. Melt dispersions of the melt formers (thermal solvents) having the specified structures MF1 to MF22 were prepared, including the following comparatively ineffective melt former MF-14:

MF14
clogP
6.39
mp ° C.
129–132
42150-54-9

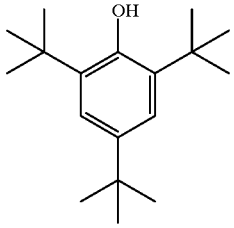

Coupler Dispersion Disp-1:

An oil based coupler dispersion was prepared containing coupler M-1, tri-cresyl phosphate and 2-butoxy-N, N-dibutyl-5-(1,1,3,3-tetramethylbutyl)-benzenamine, at a weight ratio of 1:0.8:0.2.

Coupler M-1

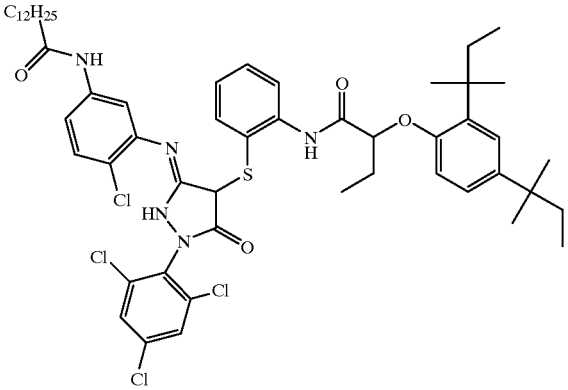

Incorporated Developer (Dev-1):

D-12

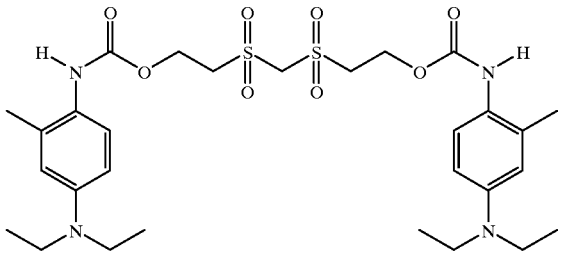

Developer Dispersion DD-1:

This material was ball-milled in an aqueous mixture, for 4 days using Zirconia beads in the following formula. For 1 g of incorporated developer, sodium tri-isopropylnaphthalene sulfonate (0.1 g), water (to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

Coating Evaluation:

The resulting coatings were exposed through a step wedge to a 3.04 log lux light source at 3000K filtered by Daylight 5A, 0.6 Inconel and Wratten 9 filters. The exposure time was 0.1 seconds. After exposure, the coating was thermally processed by contact with a heated platen for 20 seconds. A number of strips were processed at a variety of platen temperatures in order to check the generality of the effects that were seen. From the density readings at each step, two parameters were obtained:

A. Onset Temperature, $T_o$: Corresponds the temperature required to produce a maximum density (Dmax) of 0.5. Lower temperatures indicate more active developers which are desirable.

B. Peak Discrimination, $D_p$: For the optimum platen temperature, the peak discrimination corresponds to the value:

$$D_p = \frac{D_{max} - D_{min}}{D_{min}}$$

Higher values of $D_p$ indicate melt formers producing enhanced signal to noise, which is desirable. The coatings listed above performed as shown in the Table 2 below.

TABLE 2

| Coating | Melt Former | Laydown | $T_o$ (° C.) | $D_P$ |
|---|---|---|---|---|
| I-1 | MF-1 | 0.86 g/m$^2$ | 136 | 14.7 |
| I-2 | MF-2 | 0.90 g/m$^2$ | 139 | 15.1 |
| I-3 | MF-3 | 0.86 g/m$^2$ | 143 | 22.4 |
| I-5 | MF-4 | 0.86 g/m$^2$ | 143 | 6.3 |
| I-6 | MF-5 | 0.86 g/m$^2$ | 141 | 15.0 |

The data show consistently good onset temperatures and discriminations which are characteristics of effective melt formers.

Samples of unexposed coatings I-1 to I-6 were conditioned to 50% relative humidity and then incubated for 4 weeks at 38° C. in sealed envelopes. The density formation after exposure and processing was compared to samples conditioned to 50% relative humidity and kept in a freezer. The difference in Dmin values (test-freezer check) are tabulated below in Table 3. They show consistently small changes in Dmin.

TABLE 3

| Coating | Melt Former | Laydown | Δ Dmin |
|---|---|---|---|
| I-1 | MF-1 | 0.86 g/m$^2$ | 0.13 |
| I-2 | MF-2 | 0.90 g/m$^2$ | 0.09 |
| I-3 | MF-3 | 0.86 g/m$^2$ | 0.03 |
| I-5 | MF-4 | 0.86 g/m$^2$ | 0.03 |
| I-6 | MF-5 | 0.86 g/m$^2$ | 0.09 |

Example 2

Coatings were made using the same format as for Example 1 except the developer used was Dev-2 (D-3), coated at 1.18 g/m$^2$ Dev-2

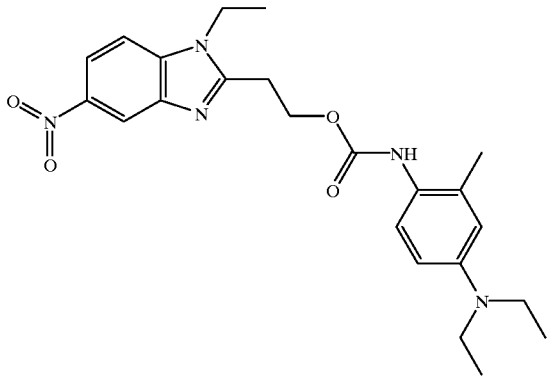

Data from these coatings is shown in the following Table 4.

TABLE 4

| Coating | Melt Former | Laydown | $T_o$ (° C.) | $D_P$ |
|---|---|---|---|---|
| I-7 | MF-1 | 0.65 g/m$^2$ | 134 | 8.1 |
| I-8 | MF-2 | 0.69 g/m$^2$ | 137 | 10.1 |
| I-9 | MF-3 | 0.65 g/m$^2$ | 148 | 9.7 |
| I-10 | MF-4 | 0.80 g/m$^2$ | 144 | 3.4 |
| I-11 | MF-5 | 0.65 g/m$^2$ | 140 | 7.3 |

Samples of unexposed coatings I-1 to I-6 were conditioned to 50% relative humidity and then incubated for 4 weeks at 38° C. in sealed envelopes. The density formation after exposure and processing was compared to samples conditioned to 50% relative humidity and kept in a freezer. The differences in Dmin values are tabulated in TABLE 5 below.

TABLE 5

| Coating | Melt Former | Laydown | Δ Dmin |
|---|---|---|---|
| I-7 | MF-1 | 0.65 g/m$^2$ | 0.17 |
| I-8 | MF-2 | 0.69 g/m$^2$ | 0.23 |
| I-9 | MF-3 | 0.65 g/m$^2$ | 0.09 |
| I-10 | MF-4 | 0.80 g/m$^2$ | 0.08 |
| I-11 | MF-5 | 0.65 g/m$^2$ | 0.20 |

Example 3

This example illustrates the use of various thermal solvents according to the present invention. Coatings were made using the same format as for Example 1 except the laydowns of all components, emulsion and dispersions used in all layers, were increased by 30% as indicated in Table 6 below.

TABLE 6

| Coating | Melt Former | Laydown | $T_o$ (° C.) | $D_P$ |
|---|---|---|---|---|
| I-12 | MF-1 | 1.12 g/m$^2$ | 134 | 13.3 |
| I-13 | MF-2 | 1.19 g/m$^2$ | 135 | 8.4 |
| I-14 | MF-6 | 1.19 g/m$^2$ | 137 | 12.4 |
| I-15 | MF-7 | 1.19 g/m$^2$ | 148 | 11.5 |
| I-16 | MF-8 | 0.86 g/m$^2$ | 148 | 4.9 |
| I-17 | MF-9 | 1.20 g/m$^2$ | 143 | 7.9 |
| I-18 | MF-10 | 1.20 g/m$^2$ | 146 | 10.5 |
| I-19 | MF-11 | 1.96 g/m$^2$ | 146 | 7.1 |

Example 4

Photographic coatings were prepared using a very simple hand-coated format comprising a layer as described in Table 1 of Example 1 in which emulsion E-1 was replaced, at the same laydown, by emulsion E-2, a 98% silver bromide, 2% silver iodide, containing tabular emulsion with an equivalent circular diameter of 0.42 microns and a thickness of 0.06 microns. No overcoat layer or hardener was applied to these coatings. The melt formers were incorporated as solid particle dispersions, similarly prepared to those in earlier examples. The resulting coatings were exposed through a step wedge to a 3.04 log lux light source at 3000K filtered by Daylight 5A, 0.6 Inconel and Wratten 9 filters. The exposure time was 0.1 seconds. After exposure, each coating was thermally processed by contact with a heated platen for 20 seconds. Strips were processed at platen temperatures of 145° C. and 150° C. in order to check the generality of the effects that were seen. From the density readings at each step, the maximum densities formed were recorded and compared to that formed by MF1 to give a relative measure of melt-former ability. These data are tabulated in Table 7 below.

TABLE 7

| | Dmax 145° C. | Dmax 150° C. |
|---|---|---|
| MF1 | 1.24 | 1.64 |
| MF12 | 0.50 | 0.91 |
| MF13 | 0.29 | 0.74 |
| MF14 (Comp.) | No image | No image |
| MF15 | 1.73 | 1.80 |
| MF16 | 1.76 | 2.23 |
| MF17 | 1.06 | 1.75 |
| MF18 | No image | 0.45 |
| MF19 | 0.64 | 1.03 |

Only MF14 (a comparison) was not effective (inactive) as a melt former. It is thought that the phenol is too sterically hindered to contribute successfully to hydrogen bonding processes necessary for effective melt formation.

Example 5

In a similar experiment to the preceding example, the following maximum density data were obtained.

TABLE 8

| | Dmax 145° C. | Dmax 150° C. | Dmax 155° C. |
|---|---|---|---|
| MF1 | 0.51 | — | 1.64 |
| MF20 | 0.38 | 1.02 | 1.78 |
| MF21 | No image | No image | Feint Image |
| MF22 | 0.19 | 0.38 | 1.21 |

In this experiment, coatings of MF21 showed many large crystals in the coating, which is evidence of recrystallization of the melt former particle dispersion during the coating experiment. The formation of large crystals, because this material was too water soluble, drastically lowered its effectiveness as a melt former. It would be expected to have a high onset temperature because of the low reactivity expected from the large crystals it formed in the coating.

The melt formers, useful in the invention, were either commercially available or simply made in few steps from commercial materials. The following examples describe the synthesis of example blocked compounds useful in the invention.

Example 6

This Example illustrates the preparation of compound D-1, useful in the present invention which is prepared according to the following reaction scheme:

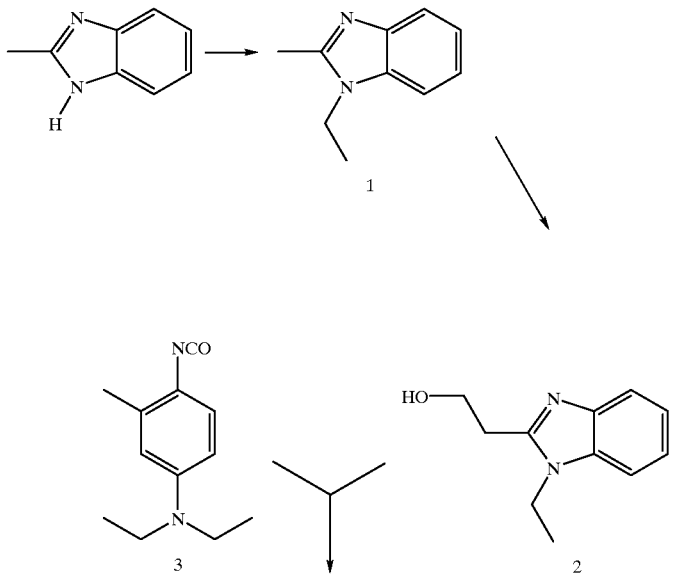

-continued

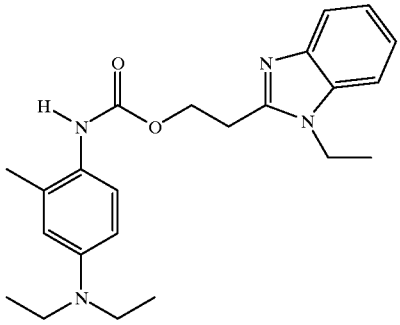

D-1

Preparation of Intermediate 1:

To a mixture of KOH (85%) (7.3 g, 110 mmol), $K_2CO_3$ (6.8 g, 50 mmol), 2-methylbenzimidazole (Aldrich, 13.2 g, 100 mmol) and THF (70 mL) was added at ca. 15° C. diethyl sulfate (11.3 mL, 102 mmol) in 10 mL of THF. After stirring for four hours, 50 mL of ethyl acetate was added, and then the reaction mixture was filtered to remove solid materials. The filtrate was concentrated under reduced pressure to yield 15.5 g (97%) of 1 as a yellow oil.

Preparation of Intermediate 2:

A pressure bottle was charged with compound 1 (8.0 g, 50 mmol), a 38% solution of formaldehyde (12 mL), pyridine (6 mL) and propanol (20 mL) and the reaction mixture was heated at 130° C. for 9 hours. The excess solvent was removed under reduced pressure and the residue recrystallized from ethyl acetate to yield compound 2 (14.5 g, 73%) as a solid; $^1$H NMR (300 MHz, $CDCl_3$): 1.40 (t, 3H, J=7.3 Hz), 3.04 (t, 2H, J=5.3 Hz), 4.10–4.20 (m, 5H), 7.18–7.34 (m, 3H), 7.65–7.72(m, 1H).

Preparation of D-1:

To a mixture of 2 (5.7 g, 30 mmol), dichloromethane (30 mL) and two drops of dibutyltin diacetate was added compound 3, namely 4-(N,N-diethylamino)-2-methylphenyl isocyanate, the latter prepared as described in Brit. Pat. 1,152,877, (6.1 g, 30 mmol). After being stirred at room temperature for 14 hours the reaction mixture was concentrated under reduced pressure and diluted with ligroin. The precipitated solid material was isolated by filtration to yield D-1 (9.6 g, 81%); $^1$H NMR (300 MHz, $CDCl_3$): 1.12 (t, 6H, J=7.3 Hz), 1.30–1.46 (m, 3H), 2.18 (s, 3H), 3.20–3.35 (m, 6H), 4.10–4.35 (m, 3H), 4.60–4.68 (m, 3H), 6.18 (bs, 1H), 6.40–6.55 (m, 2H), 7.20–7.44 (m, 4H), 7.69–7.75 (m, 1H).

Example 7

This Example illustrates the preparation of compound D-12, or Dev-1, useful in the present invention, which is prepared according to the following reaction scheme:

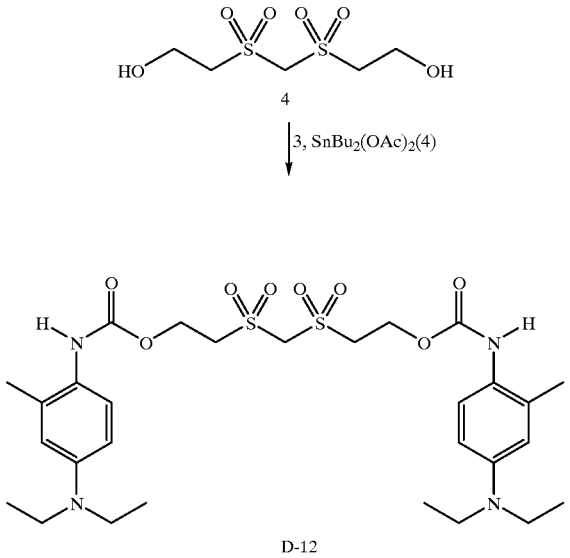

Preparation of D-12 (Dev-1):

A solution of the diol 4 (15.0 g, 64 mmol), compound 3 (27.0 g, 130 mmol) and dibutyltin diacetate (0.05 mL) in 150 mL of tetrahydrofuran was stirred at room temperature for 18 h. The reaction mixture was then filtered through a pad of Celite and the filtrate concentrated in vacuo, giving a solid, which was recrystallized from methanol. The yield of D-12 was 25.0 g (40 mmol, 61%), m.p. 131° C.

Example 8

This Example illustrates the preparation of compound D-15, useful in the present invention, which is prepared according to the following reaction scheme:

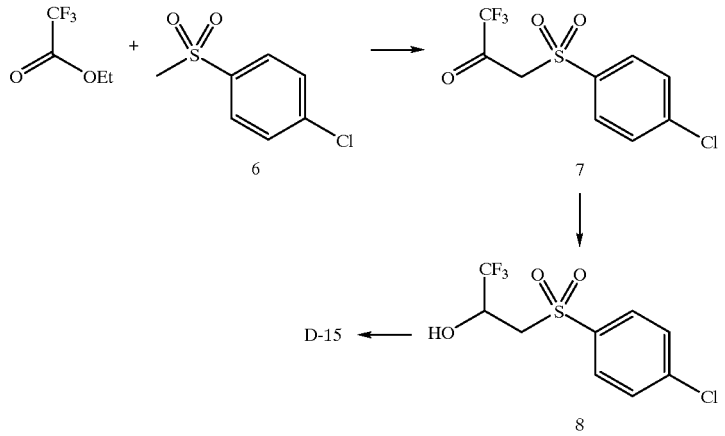

Preparation of Intermediate 7:

A solution of sulfone 6 (19.07 g, 100 mmol) in 50 mL of N,N-dimethylformamide was added to a suspension of 60% sodium hydride (6.00 g, 150 mmol) in 100 mL of N,N-dimethylfornamide, the mixture was stirred at 40° C. for 90 min and then cooled to 5° C. Neat ethyl trifluoroacetate (36 mL, 300 mmol) was added at 5° C. and then the reaction mixture stirred at room temperature for 30 min. The mixture was diluted with 1000 mL of brine and extracted with ether, giving an oil which was purified by column chromatography on silica gel. A solid was obtained which was further purified by crystallization from hexane-isopropyl ether. The yield of 7 was 18.47 g (64 mmol, 64%).

Preparation of Intermediate 8:

Solid sodium borohydlide (1.89 g, 50 mmol) was added in portions to a solution of 7 (14.33 g, 50 mmol) in 100 mL of methanol and the mixture stirred for 30 min. Water (200 mL) was then added and methanol distilled off. Extraction with ether and removal of the solvent gave 13.75 g (48 mmol, 95%) of 8.

Preparation of D-15:

A solution of 7 (13.75 g, 48 mmol, 4-(N,N-diethylamino)-2-methylphenyl isocyanate (3, 10.21 g, 50 mmol) and dibutyltin diacetate (0.01 mL) in 50 mL of dichloromethane was stirred at room temperature for 4 days. The solvent was distilled off and the crude product washed with hexane and dried. The yield of D-15 was 21.00 g (43 mmol, 85%), m.p. 140–143° C.

Example 9

This Example illustrates the preparation of compound D-23, useful in the present invention, which is prepared according to the following reaction scheme:

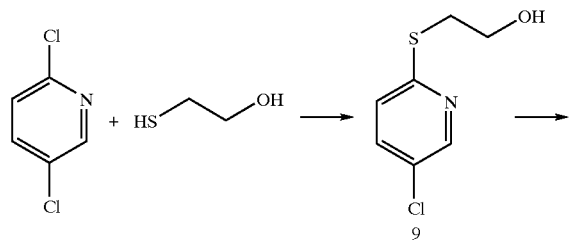

-continued

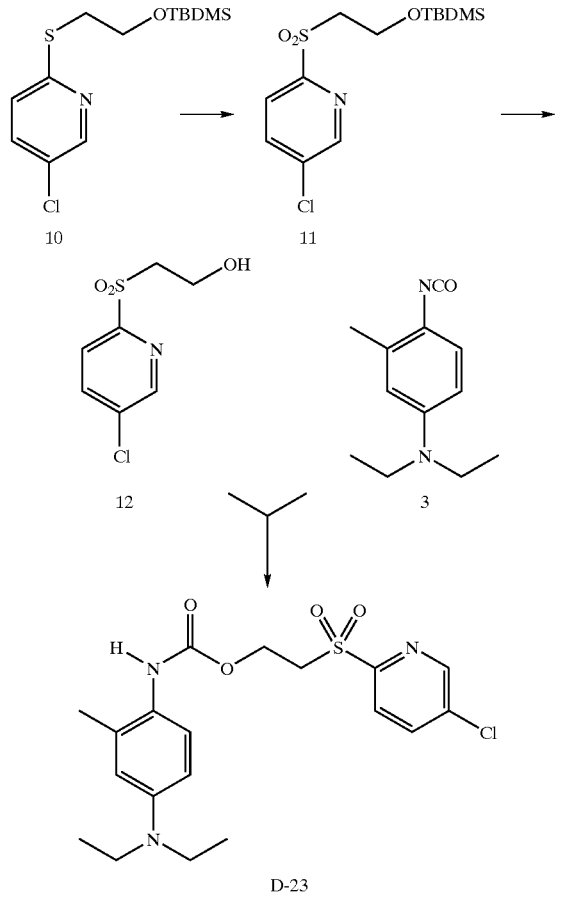

Preparation of Intermediate 9:

A mixture consisting of 2,5-dichloropyridine (Aldrich, 14.80 g, 100 mmol), 2-mercaptoethanol (Fluka, 9.36 g, 120 mmol), potassium carbonate (19.34 g, 140 mmol), and acetone (200 mL) was refluxed for 36 h, cooled to room temperature and filtered. The filtrate was concentrated in vacuo, dissolved in ether (300 mL) and washed with brine 2×100 mL). The organic solution was concentrated and the crude product purified by column chromatography on silica gel with heptane/ethyl acetate. The yield of 9 was 12.05 g (64 mmol, 64%).

Preparation of Intermediate 10:

Solid tert-butyldimethylsilyl chloride (Aldrich, TBDMSCl, 11.34 g, 75 mmol) was added in one portion to a solution of 9 (11.86 g, 62.5 mmol) and imidazole (5.97 g, 87.5 mmol) in tetrahydrofuran (160 mL), stirred at 5° C. Following the addition, the mixture was stirred at room temperature for 20 h and then worked up with saturated aqueous sodium bicarbonate and ether. The product was purified by column chromatography on silica gel with heptane/ethyl acetate. The yield of 10 was 17.69 g (58 mmol, 93%).

Preparation of Intermediate 11:

A solution of meta-chloroperbenzoic acid (mCPBA, 77%, 27.01 g, 120 mmol) in dichloromethane (150 mL) was added in drops over a period of 30 min to a solution of 10 in dichloromethane (200 mL), stirred at 5° C. Following the addition the mixture was stirred at room temperature for 22 h and quenched with saturated aqueous sodium bicarbonate, followed by extraction with dichloromethane and column chromatography (silica, heptane/dichloromethane) which gave 11.67 g (35 mmol, 87%) of 11.

Preparation of Intermediate 12:

A solution of 11 (10.08 g, 30 mmol) in tetrahydrofuran (90 mL) water (90 mL)/acetic acid (270 mL,) was kept at room temperature for 4 days. The solvents were distilled off and the residue crystallized from heptane/isopropyl ether. The yield of 12 was 6.41 g (29 mmol, 96%).

Preparation of D-23:

A solution of 12 (4.43 g, 20 mmol) and compound 3, namely 4-(N,N-diethylamino)-2-methylphenyl isocyanate, the latter prepared as described in Brit. Pat. 1,152,877 (4.08 g, 20 mmol), and dibutyltin diacetate (0.01 mL) was stirred in 35 mL of tetrahydrofuran at room temperature for 24 hours. The solvent was distilled off and the crude oily product stirred with 50 mL of isopropyl ether, giving colorless crystals of D-23 (8.18 g, 19.2 mmol, 96%), m.p. 84–85° C.

Example 10

This Example illustrates the preparation of compound D-33, useful in the present invention, which is prepared according to the following reaction scheme:

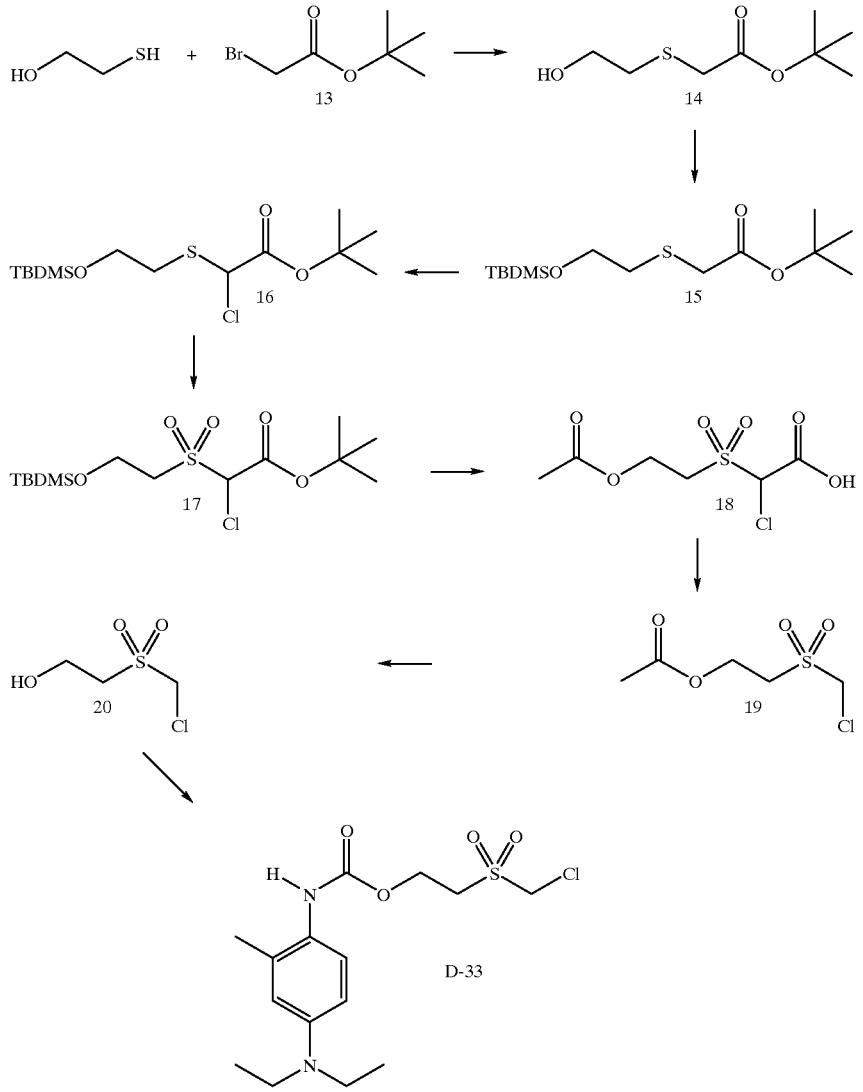

Preparation of Intermediate 14:

A solution of t-butyl bromoacetate 13 (Aldiich, 19.51 g, 100 mmol) in 100 mL of acetonitrile was added in drops over a period of 30 min to a cooled (5° C.) solution of 2-mercaptoethanol (8.19 g, 105 mmol) in 100 mL of acetonitrile, containing potassium carbonate (15.20 g, 110 mmol). Following the addition the mixture was stirred at room temperature for 3 h and filtered. The filtrate was diluted with 200 mL of ether and washed with brine (50 mL). The ethereal solution was dried over sodium sulfate and concentrated in vacuo to give 19.24 g of 14 (100 mmol, 100%).

Preparation of Intermediate 15:

Solid tert-butyldimethylsilyl chloride (TBDMSCl, 18.09 g, 120 mmol) was added in one portion to a solution of 14 (19.24 g, 100 mmol) and imidazole (9.55 g, 140 mmol) in 250 mL of tetrahydrofuran, stirred under nitrogen. After 2 h at room temperature the mixture was quenched with 200 mL of saturated aqueous sodium bicarbonate and extracted with ether. The crude product was filtered through silica gel (ether/heptane) giving 29.21 g (95 mmol, 95%) of 15.

Preparation of Intermediate 16:

Solid N-chlorosuccinimide (6.68 g, 50 mmol) was added in portions over a period of 30 min to a solution of 15 (15.33 g, 50 mmol) in 100 mL of carbon tetrachloride that was stirred at 5° C. The reaction was run for 2 h and filtered. Removal of the solvent left 17.44 g of 16 as an oil (50 mmol, 100%).

Preparation of Intermediate 17:

A solution of m-chloroperbenzoic acid (mCPBA, 77%, 24.75 g, 110 mmol) in 200 mL of dichloromethane was added in drops over a period of 30 min to a solution of 16 (17.44 g, 50 mmol) in 100 mL of dichloromethane, stirred at 5° C. Following the addition, the mixture was stirred at 5° C. for 2 h and then at room temperature for 1 h. The reaction was quenched with saturated aqueous sodium bicarbonate (250 mL) and the organic layer was dried and concentrated giving 18.66 g of 17 as an oil (50 mmol, 100%).

Preparation of Intermediate 18:

A solution of 17 (11.26 g, 30.2 mmol), acetic anhydride (5 mL) and p-toluenesulfonic acid monohydiate (100 mg) in acetic acid (150 mL) was refluxed for 1 h. The solution was cooled to room temperature, diluted with 100 mL of water and stirred for 2 h. A solid was filtered off and the filtrate was concentrated in vacuo to produce 18 as a colorless oil.

Preparation of Intermediate 19:

A solution of crude 18 and sodium acetate (2.46 g, 30 mmol) in acetic acid (30 mL) was refluxed for 15 min, cooled to room temperature and the solvent was distilled off. The residue was worked up with water and ethyl acetate, giving 5.66 g of 19 as an oil.

Preparation of Intermediate 20:

A solution of crude 19 and concentrated hydrochloric acid (0.5 mL) in 75 mL of methanol was stirred at room temperature for 3 days. The solvent was distilled off leaving 4.61 g of 20 (29 mmol, 96% based on 17).

Preparation of D-33:

A solution of 20 (1.59 g, 10 mmol), 3 (2.25 g, 11 mmol) and dibutyltin diacetate (0.02 mL) in acetonitrile (10 mL) was kept at room temperature in a stoppered flask for 24 h. The solvent was removed giving an oil which crystallized when stirred with isopropyl ether. The solid was collected, washed with isopropyl ether and dried. The yield of D-33 was 3.03 g (8.3 mmol, 83%), m.p. 96–98° C., ESMS: $ES^+$, m/z 363 (M+1, 95%).

Example 11

This Example illustrates a multilayer photographic element containing a phenolic melt former, in this case salicylanilide.

Silver Halide Emulsions:

The emulsions employed in these examples are all silver iodobromide tabular grains precipitated by conventional means as known in the art. Table 9 below lists various emulsions prepared, along with their iodide content (the remainder assumed to be bromide), their dimensions, and the sensitizing dyes used to impart spectral sensitivity. All of these emulsions have been given chemical sensitizations as known in the art to produce optimum sensitivity.

TABLE 9

| Emulsion | Spectral sensitivity | Iodide content (%) | Diameter (μm) | Thickness (μm) | Dyes |
|---|---|---|---|---|---|
| EY-3 | Yellow | 2 | 1.23 | 0.125 | SY-1 |
| EY-4 | yellow | 2 | 0.45 | 0.061 | SY-1 |
| EY-5 | yellow | 2 | 0.653 | 0.093 | SY-1 |
| EM-3 | magenta | 2 | 1.23 | 0.125 | SM-1 + SM-3 |
| EM-4 | magenta | 2 | 0.45 | 0.061 | SM-1 + SM-3 |
| EM-5 | magenta | 2 | 0.653 | 0.093 | SM-1 + SM-3 |
| EC-4 | cyan | 2 | 0.45 | 0.061 | SC-1 + SC-2 |
| EC-5 | cyan | 2 | 0.653 | 0.093 | SC-1 + SC-2 |

In addition to the components described in the previous examples, the following components were used, including a list of the chemical structures.

SM-1

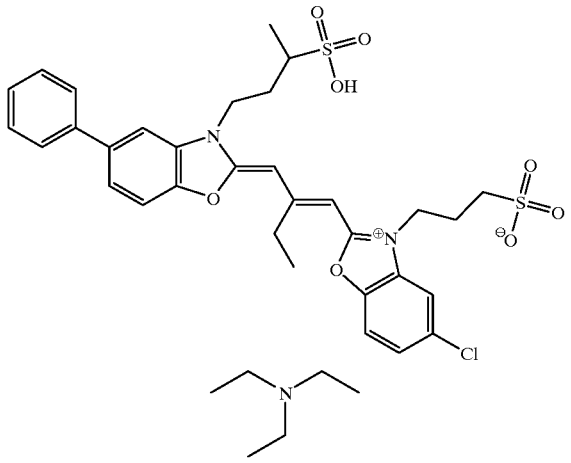

SM-2

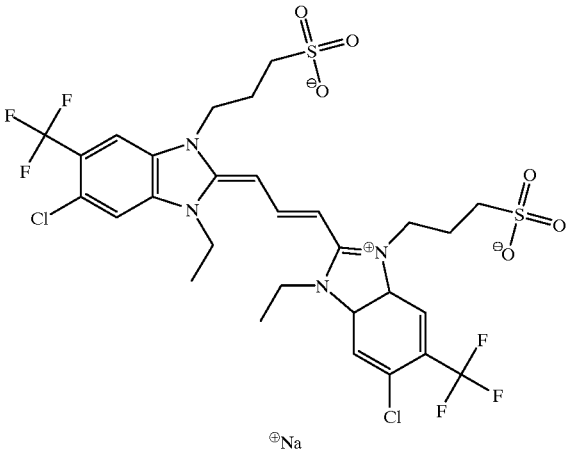

-continued

SM-3

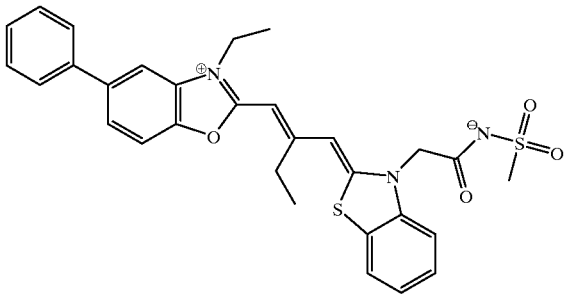

SC-1

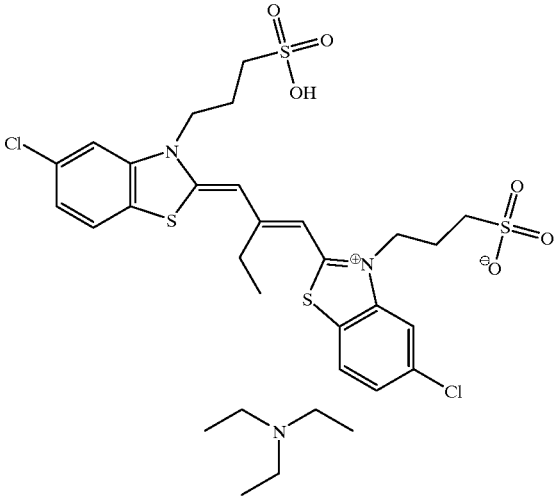

SC-2

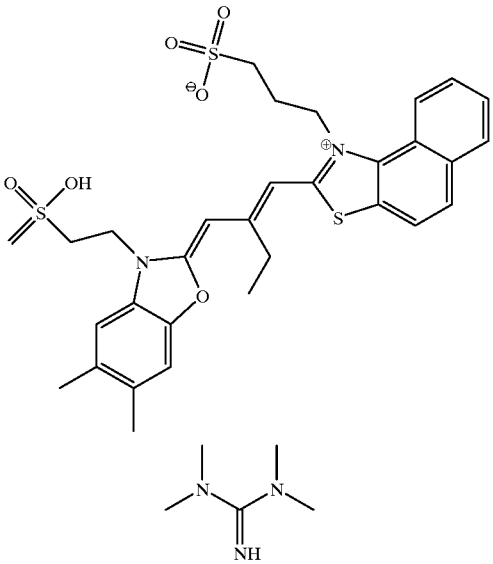

Coupler Dispersion CDM-2:

A coupler dispersion was prepared by conventional means containing coupler M-1 without any additional permanent solvents.

Coupler Dispersion CDC-1:

An oil based coupler dispersion was prepared by conventional means containing coupler C-1 and dibutyl phthalate at a weight ratio of 1:2.

Coupler Dispersion CDY-1:

An oil based coupler dispersion was prepared by conventional means containing coupler Y-1 and dibutyl phthalate at a weight ratio of 1:0.5.

C-1

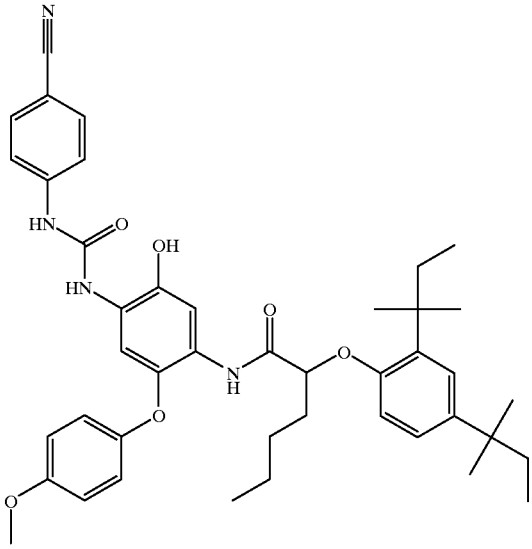

Y-1

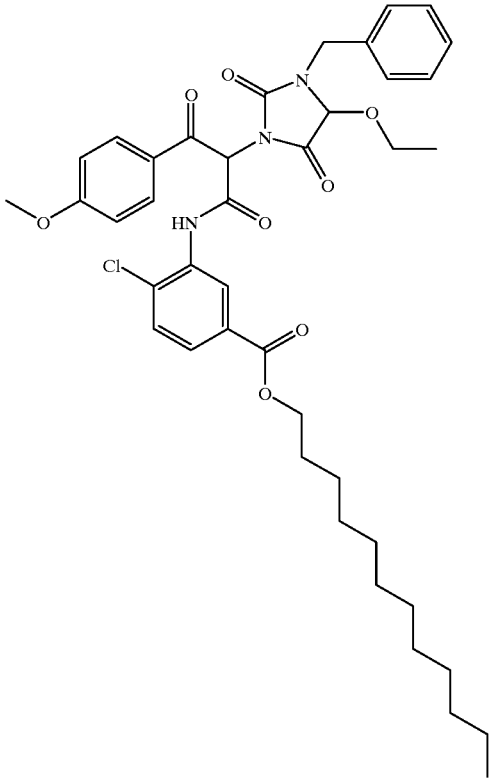

-continued

SY-1

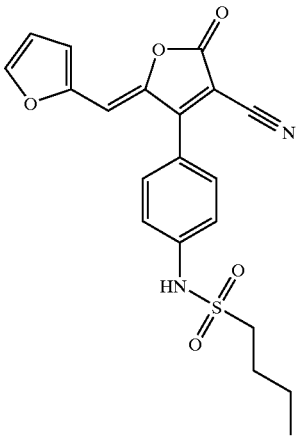

SM-1

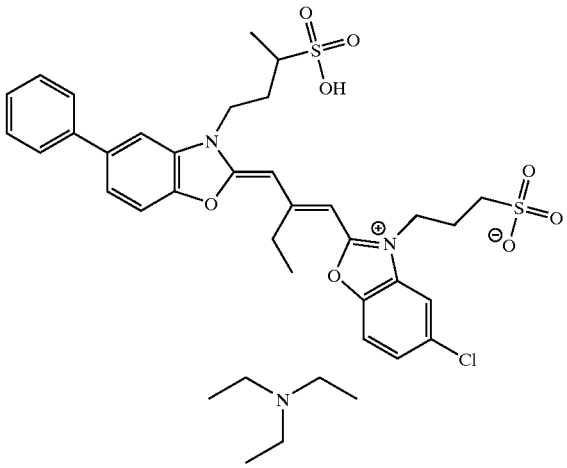

Hardener-1

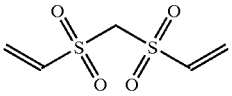

A multilayer imaging element as described in Table 10 below was created to show sufficient image formation capability to allow for use in full color photothermographic elements intended for capturing live scenes. The multilayer element of this example produced an image prior to any wet processing steps.

TABLE 10

| | |
|---|---|
| | 1.1 g/m$^2$ Gelatin |
| Overcoat | 0.32 g/m$^2$ Hardener-1 |
| Fast Yellow | 0.54 g/m$^2$ AgBrI from emulsion EY-3 |
| | 0.17 g/m$^2$ silver benzotriazole from SS-1 |
| | 0.17 g/m$^2$ silver-1-phenyl-5-mercaptotetrazole from SS-2 |
| | 0.29 g/m$^2$ coupler Y-1 from dispersion CDY-1 |
| | 0.46 g/m$^2$ Developer Dev-1 |
| | 0.46 g/m$^2$ Salicylanilide |
| | 2.3 g/m$^2$ Gelatin |
| Slow | 0.27 g/m$^2$ AgBrI from emulsion EY-4 |
| Yellow | 0.16 g/m$^2$ AgBrI from emulsion EY-5 |
| | 0.15 g/m$^2$ silver benzotriazole from SS-1 |
| | 0.15 g/m$^2$ silver-1-phenyl-5-mercaptotetrazole from SS-2 |
| | 0.25 g/m$^2$ coupler Y-1 from dispersion CDY-1 |
| | 0.40 g/m$^2$ Developer Dev-1 |
| | 0.40 g/m$^2$ Salicylanilide |
| | 2.0 g/m$^2$ Gelatin |

TABLE 10-continued

| | |
|---|---|
| Yellow | 0.08 g/m$^2$ SY-1 |
| Filter | 1.07 g/m$^2$ Gelatin |
| Fast | 0.54 g/m$^2$ AgBrI from emulsion EM-3 |
| Magenta | 0.17 g/m$^2$ silver benzotriazole from SS-1 |
| | 0.17 g/m$^2$ silver-1-phenyl-5-mercaptotetrazole from SS-2 |
| | 0.29 g/m$^2$ coupler M-1 from dispersion CDM-2 |
| | 0.46 g/m$^2$ Developer Dev-1 |
| | 0.46 g/m$^2$ Salicylanilide |
| | 2.3 g/m$^2$ Gelatin |
| Slow | 0.27 g/m$^2$ AgBrI from emulsion EM-4 |
| Magenta | 0.16 g/m$^2$ AgBrI from emulsion EM-5 |
| | 0.15 g/m$^2$ silver benzotriazole from SS-1 |
| | 0.15 g/m$^2$ silver-1-phenyl-5-mercaptotetrazole from SS-2 |
| | 0.25 g/m$^2$ coupler M-1 from dispersion CDM-2 |
| | 0.40 g/m$^2$ Developer Dev-l |
| | 0.40 g/m$^2$ Salicylanilide |
| | 2.0 g/m$^2$ Gelatin |
| Interlayer | 1.07 g/m$^2$ Gelatin |
| Fast Cyan | 0.54 g/m$^2$ AgBrI from emulsion EC-3 |
| | 0.17 g/m$^2$ silver benzotriazole from SS-1 |
| | 0.17 g/m$^2$ silver-1-phenyl-5-mercaptotetrazole from SS-2 |
| | 0.29 g/m$^2$ coupler C-1 from dispersion CDC-1 |
| | 0.46 g/m$^2$ Developer Dev-1 |
| | 0.46 g/m$^2$ Salicylanilide |
| | 2.3 g/m$^2$ Gelatin |
| Slow Cyan | 0.27 g/m$^2$ AgBrI from emulsion EC-4 |
| | 0.16 g/m$^2$ AgBrI from emulsion EC-5 |
| | 0.15 g/m$^2$ silver benzotriazole from SS-1 |
| | 0.15 g/m$^2$ silver-1-phenyl-5-mercaptotetrazole from SS-2 |
| | 0.25 g/m$^2$ coupler C-1 from dispersion CDC-1 |
| | 0.40 g/m$^2$ Developer Dev-1 |
| | 0.40 g/m$^2$ Salicylanilide |
| | 2.0 g/m$^2$ Gelatin |
| Antihalation | 0.05 g/m$^2$ Carbon |
| Layer | 1.6 g/m$^2$ Gelatin |
| Support | Polyethylene terephthalate support (7 mil thickness) |

The resulting coating was exposed through a step wedge to a 1.8 log lux light source at 5500K and Wratten 2B filter. The exposure time was 0.1 seconds. After exposure, the coating was thermally processed by contact with a heated platen for 20 seconds at 145° C. Cyan, magenta, and yellow densities were read using status M color profiles, to yield the densities listed in Table 11 below. It is clear from these densities that to coating serves as a useful photographic element capturing multicolor information.

TABLE 11

| Record | Dmin | Dmax |
|---|---|---|
| Cyan | 0.38 | 1.47 |
| Magenta | 0.72 | 2.65 |
| Yellow | 0.68 | 1.80 |

The film element was further loaded into a single lens reflex camera equipped with a 50 mm/f1.7 lens. The exposure control of the camera was set to ASA 100 and a live scene indoors without the use of a flash was captured on the above element. The element was developed by heating for 20 seconds at 145° C. and no subsequent processing was done to the element.

The resulting image was scanned with a Nikon® LS2000 film scanner. The digital image file thus obtained was loaded into Adobe Photoshop® (version 5.0.2) where corrections were made digitally to modify tone scale and color saturation, thus rendering an acceptable image. The image was viewed as softcopy by means of a computer monitor. The image file was then sent to a Kodak 8650 dye sublimation printer to render a hardcopy output of acceptable quality.

The invention has been described in detail with particular reference to certain preferred embodiments thereof, but it will be understood that variations and modifications can be effected within the spirit and scope of the invention.

What is claimed is:

1. A method of image formation comprising the following steps of (a) developing an imagewise exposed photothermographic film by heating the film to a temperature within the range of about 80 to 180° C., said film being a photothermographic element comprising at least three light-sensitive units which have their individual sensitivities in different wavelength regions, each of the units comprising at least one light-sensitive silver-halide emulsion, binder, dye-providing coupler, and a blocked developer which blocked developer and coupler are developed, thereby forming a developed image within each of the units, in the presence of a thermal solvent for promoting development in a dry or substantially dry process, which thermal solvent has a melting point of at least 80° C., comprises a phenolic ring and has the following formula:

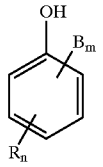

wherein the substituent B is independently selected from a substituent where an oxygen, carbon, nitrogen phosphorus or sulfur atom is linked to the phenolic ring as part of an ester, amido, ether, aminosulfonyl, sulfamoyl, carbonyl, acyl or sulfonyl group;

m is 0 to 4; and wherein the substituent R is independently selected from a substituted or unsubstituted alkyl, cycloalkyl, aryl, alkylaryl, or forms a ring with another substituent on the ring;

n is 0 to 4; and wherein m+n is 1 to 5; and (b) scanning said developed image in the imagewise exposed and developed film to form a first electronic image representation of said imagewise exposure.

2. The method of claim 1 wherein B is selected from the group consisting of —C(=O)NHR$^2$, —NHC(=O)R$^2$, —NHSO$_2$R$^2$, —COR$^2$, —SO$_2$NHR$^2$, and —SO$_2$R$^2$ wherein R$^2$ is substituted or unsubstituted alkyl, cycloalkyl, aryl, alkylaryl, heterocyclic group and can optionally comprise a phenolic hydroxyl group.

3. The method of claim 1 wherein the melting point is between 100 and 250° C.

4. The method of claim 2 wherein n is 1 and R$^2$ is a substituted or unsubstituted phenyl substituent.

5. The method of claim 1 wherein the thermal solvent is 2-hydroxybenzamide or a derivative thereof.

6. The method of claim 1 in which the thermal solvent is present in the amount of 0.01 times to 0.5 times the amount by weight of coated gelatin per square meter.

7. The method of claim 1, comprising a radiation sensitive silver halide, and a thermal solvent represented by the following structure

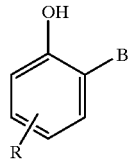

wherein B and R are as described in claim 1.

8. The method of claim 2 wherein the thermal solvent is selected from the group consisting of:

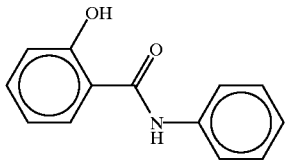

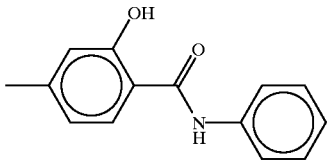

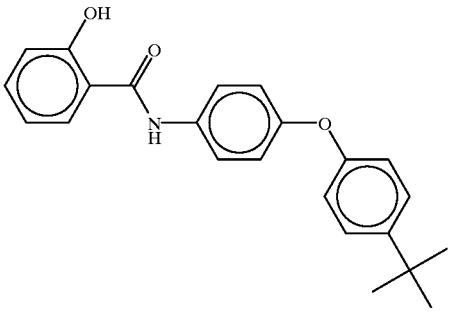

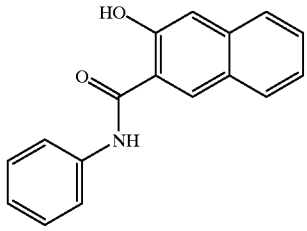

-continued

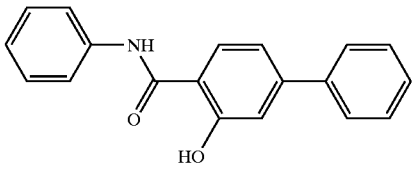

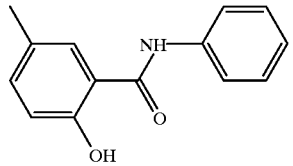

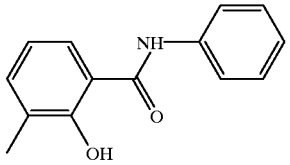

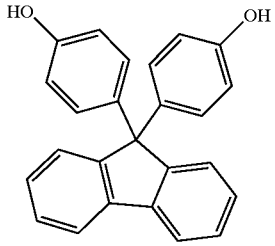

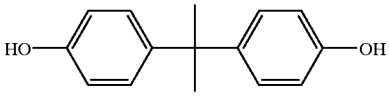

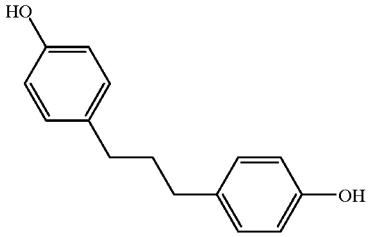

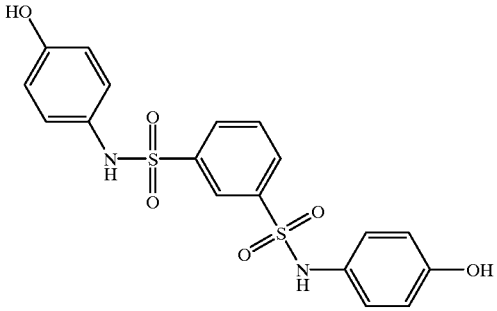

9. The method according to claim 1, wherein the blocked developer is a compound represented by the following structure:

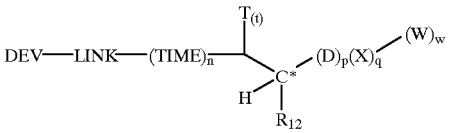

wherein:

DEV is a developing agent;

LINK is a linking group;

TIME is a timing group;

n is 0, 1, or 2;

t is 0, 1, or 2, and when t is not 2, the necessary number of hydrogens (2-t) are present in the structure;

C* is tetrahedral ($sp^3$ hybridized) carbon;

p is 0 or 1;

q is 0 or 1;

w is 0 or 1; p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group that is either an $R_{13}$ or an $R_{13}$ and $R_{14}$ group; or T is joined with W or $R_{12}$ to form a ring; or two T groups can combine to form a ring;

D is a first activating group selected from substituted or unsubstituted (referring to the following D groups) heteroaromatic group or aryl group or monovalent electron withdrawing group, wherein said heteroaromatic group can optionally form a ring with T or $R_{12}$;

X is a second activating group and is a divalent electron withdrawing group;

W is W' or a group represented by the following structure:

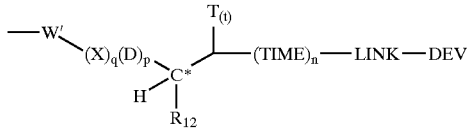

W' is independently selected from a substituted or unsubstituted (referring to the following W' groups) alkyl, cycloalkyl, aryl or heterocyclic group; and wherein W' in combination with T or $R_{12}$ can form a ring;

$R_{13}$, $R_{14}$, $R_{15}$, and $R_{16}$ can independently be selected from substituted or unsubstituted alkyl, aryl, or heterocyclic group;

any two members of the following set: $R_{12}$, T, and either D or W, that are not directly linked may be joined to form a ring, provided that creation of the ring will not interfere with the functioning of a blocking group in the blocked developer;

wherein the T, $R_{12}$, D, X and W groups are selected such that the blocked developer has a half-life ($t_{1/2}$)≦20 min, and a peak discrimination, at a temperature of at least 60° C., of at least 2.0.

10. The method of claim 1 wherein peak discrimination is 3 to 10 and peak discrimination is at a temperature of 100 to 160° C.

11. The method of claim 9, wherein the blocked developer is a compound represented by the following structure:

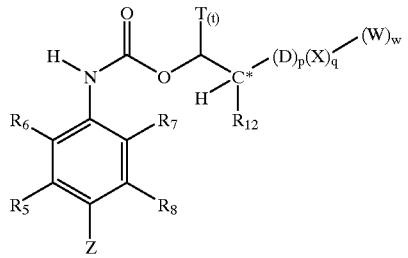

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following structure:

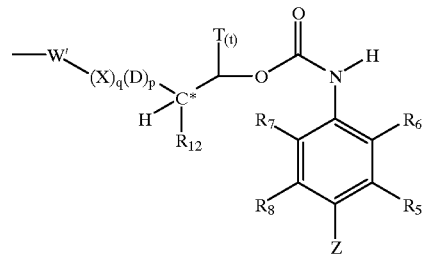

wherein T, t, C*, $R_{12}$, D, p, X, q, W' and w are as defined above.

12. The method according to claim 9, wherein X is a sulfonyl or a cyano group and Z is $NR_2R_3$.

13. The method according to claim 1 wherein the photothermographic element contains an imaging layer comprising, in addition to the blocked developer, a light sensitive silver halide emulsion, and a non-light sensitive silver salt oxidizing agent.

14. The method according to claim 1 comprising a mixture of at least two organic silver salts, at least one of which is a non-light sensitive silver salt oxidizing agent.

15. A method of image formation comprising the following steps:

(a) developing an imagewise exposed photothermographic film by heating the film to a temperature within the range of about 80 to 180° C., said film being a photothermographic element comprising at least three light-sensitive units which have their individual sensitivities in different wavelength regions, each of the units comprising at least one light-sensitive silver-halide emulsion, binder, and dye-providing coupler, and a blocked developer which blocked developer and coupler are developed, thereby forming a developed image within each of the units, in the presence of a thermal solvent for promoting development in a dry or substantially dry process, which thermal solvent has a melting point of at least 80° C., comprises a phenolic ring and has the following formula:

(I)

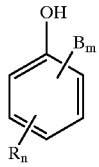

wherein the substituent B is independently selected from a substituent where an oxygen, carbon, nitrogen, phosphorus or sulfur atom is linked to the phenolic ring as part of a ketone, aldehyde, ester, amido, carbamate, ether, aminosulfonyl, sulfamoyl, sulfonyl, amine, phosphine, or aromatic heterocyclic group;

m is 0 to 4; and wherein the substituent R is independently selected from a substituted or unsubstituted alkyl, cycloalkyl, aryl, alkylaryl, or forms a ring with another substituent on the ring;

n is 0 to 4; and wherein m+n is 1 to 5; and (b) scanning said developed image in the imagewise exposed and developed film to form a first electronic image representation of said imagewise exposure.

16. The method of claim 15 wherein B is selected from the group consisting of —C(=O)NHR², —NHC(=O)R², —NHSO₂R², —SO₂NHR², —SO₂R², —C(=O)R², —C(=O)OR², and —OR², wherein R² is substituted or unsubstituted alkyl, cycloalkyl, aryl, alkylaryl, heterocyclic group and can optionally comprise a phenolic hydroxyl group.

17. The method of claim 15 wherein when m is 0, n is at least 1 and there is a second phenolic group on an R substituent.

18. The method of claim 15 wherein the thermal solvent has the following structure:

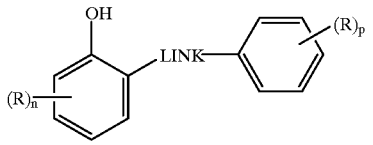

wherein LINK is selected from the group consisting of —C(=O)NH—, —NHC(=O)-, —NHSO$_2$—, —C(=O)—, —C(=O)O—, —O(R$^3$)—, —SO$_2$NH—, and —SO$_2$—; where R$^3$ is an alkyl group and R and n is as defined above; and p is 0 to 4.

19. The method of claim 18 wherein R is independently selected from substituted or unsubstituted C1 to C10 alkyl group.

20. The method of claim 15 wherein n+p is 1 and R is a C1 to C6 alkyl group.

21. The method of claim 15 wherein the thermal solvent is selected from the group consisting of:

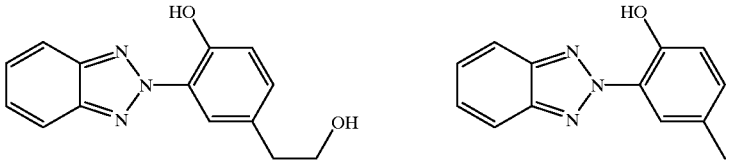

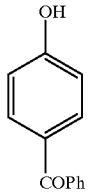

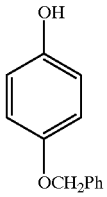

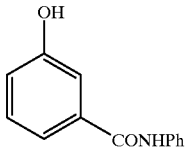

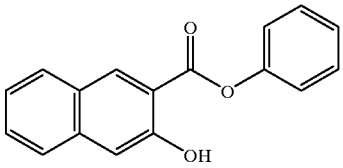

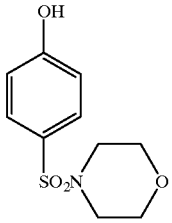

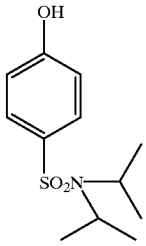

and

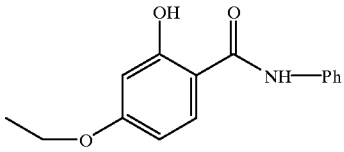

22. The method according to claim 15, wherein said developing comprises treating said imagewise exposed element at a temperature between about 80° C. and about 180° C. for a time ranging from about 0.5 to about 60 seconds.

23. The method according to claim 15, wherein said developing comprises treating said imagewise exposed element to a volume of processing solution is between about 0.1 and about 10 times the volume of solution required to fully swell the photographic element.

24. The method according to claim 15, wherein the developing is accompanied by the application of a laminate sheet containing additional processing chemicals.

25. The method according to claim 15, wherein the applied processing solution is a base, acid, or pure water.

26. The method according to claim 15 wherein the image formation comprises the step of digitizing a first electronic image representation formed from an imagewise exposed, developed, and scanned imaging element to form a digital image.

27. The method according to claim 15 wherein image formation comprising the step of modifying a first electronic image representation formed from an imagewise exposed, developed, and scanned imaging element formulated to form a second electronic image representation.

28. The method according to claim 15 comprising storing, transmitting, printing, or displaying an electronic image representation of an image derived from an imagewise exposed, developed, scanned imaging element.

29. The method according to claim 28, wherein printing the electronic image representation is accomplished with one of the following: electrophotography; inkjet; thermal dye sublimation; or CRT or LED printing to sensitized photographic paper.

30. The method according to claim 15 wherein the melt former has a melting point of at least 100° C.

31. The method according to claim 15 wherein the melt former has a melting point of at least 100° C. but melts at the temperature of development to obtain image formation.

* * * * *